US009735511B2

(12) United States Patent
Kao et al.

(10) Patent No.: US 9,735,511 B2
(45) Date of Patent: Aug. 15, 2017

(54) ELECTRICAL RECEPTACLE CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Wen-Yu Wang, New Taipei (TW); Wen-Hsien Tsai, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/667,158

(22) Filed: Mar. 24, 2015

(65) Prior Publication Data

US 2015/0270661 A1 Sep. 24, 2015

(30) Foreign Application Priority Data

Mar. 24, 2014 (TW) ..... 103110939 A
Mar. 18, 2015 (TW) ..... 104108694 A

(51) Int. Cl.
*H01R 13/6585* (2011.01)
*H01R 13/52* (2006.01)
(Continued)

(52) U.S. Cl.
CPC ..... *H01R 13/6585* (2013.01); *H01R 13/5202* (2013.01); *H01R 13/6476* (2013.01); *H01R 24/60* (2013.01)

(58) Field of Classification Search
CPC ..... H01R 12/724; H01R 13/6594; H01R 13/6581; H01R 13/26; H01R 13/506;
(Continued)

(56) References Cited

U.S. PATENT DOCUMENTS 8,157,599 B2 * 4/2012 Wei ..... H01R 13/502 439/607.01
8,323,057 B2 * 12/2012 Ho ..... H01R 12/725 439/607.4
(Continued)

FOREIGN PATENT DOCUMENTS

TW M356244 5/2009
TW 201249003 12/2012
(Continued)

*Primary Examiner* — Amy Cohen Johnson
*Assistant Examiner* — Matthew T Dzierzynski
(74) *Attorney, Agent, or Firm* — Muncy, Geissler, Olds & Lowe, P.C.

(57) ABSTRACT

An electrical receptacle connector includes a metal shell, an insulation housing, upper-row plate terminals, and lower-row plate terminals. The metal shell defines a receptacle cavity to receive the insulation housing. The insulation housing includes a base portion and a tongue portion extending from one side of the base portion. The tongue portion includes an upper surface and a lower surface. The upper-row plate terminals are held on the base portion and tongue portion and include upper-row contact segments at the upper surface for transmitting first signals. The lower-row plate terminals are held on the base portion and tongue portion and include lower-row contact segments at the lower surface for transmitting second signals. The upper-row plate terminals and the lower-row plate terminals are point-symmetrical with a central point of the receptacle cavity as the symmetrical center.

32 Claims, 31 Drawing Sheets

(51) Int. Cl.

| | |
|---|---|
| *H01R 13/6594* | (2011.01) |
| *H01R 13/6582* | (2011.01) |
| *H01R 13/6476* | (2011.01) |
| *H01R 24/60* | (2011.01) |

(58) Field of Classification Search

CPC ..... H01R 13/6582; H01R 13/6471; H01R 12/707; H01R 13/08; H01R 13/6469; H01R 13/6591; H01R 13/6658; H01R 2201/06; H01R 13/6587; H01R 12/58; H01R 13/6593; H01R 13/6595; H01R 12/57; H01R 12/71; H01R 12/721

See application file for complete search history.

(56) References Cited

U.S. PATENT DOCUMENTS

| | | | | |
|---|---|---|---|---|
| 8,337,245 | B1 * | 12/2012 | Wang | H01R 12/724 439/271 |
| 8,388,380 | B1 * | 3/2013 | Van der Steen | H01R 13/5202 439/607.36 |
| 8,398,438 | B2 * | 3/2013 | Zhang | H01R 13/6471 439/660 |
| 8,905,779 | B2 * | 12/2014 | Little | H01R 13/641 439/489 |
| 8,936,492 | B2 * | 1/2015 | Ho | H01R 12/724 439/660 |
| 8,968,031 | B2 * | 3/2015 | Simmel | H01R 13/659 439/108 |
| 9,093,784 | B2 * | 7/2015 | Zhang | H01R 13/6272 |
| 9,306,337 | B2 * | 4/2016 | Yu | H01R 24/60 |
| 2010/0167584 | A1 * | 7/2010 | He | H01R 13/506 439/607.01 |
| 2013/0040501 | A1 * | 2/2013 | Peng | H05K 1/0248 439/660 |
| 2014/0342599 | A1 * | 11/2014 | Zhang | H01R 12/724 439/521 |
| 2015/0200510 | A1 * | 7/2015 | Yao | H01R 13/6463 439/638 |

FOREIGN PATENT DOCUMENTS

| | | |
|---|---|---|
| TW | M443311 U | 12/2012 |
| TW | M447007 U | 2/2013 |
| TW | M447609 | 2/2013 |
| TW | M450835 | 4/2013 |
| TW | M461178 U | 9/2013 |

* cited by examiner

100

100

| | | | | | | | | | | | | |
|---|---|---|---|---|---|---|---|---|---|---|---|---|
| GND | TX1+ | TX1− | VBUS | CC1 | D+ | D− | RFU | VBUS | RX2− | RX2+ | GND | 31 |
| GND | RX1+ | RX1− | VBUS | RFU | D− | D+ | CC2 | VBUS | TX2− | TX2+ | GND | 41 |

Fig. 4B

ELECTRICAL RECEPTACLE CONNECTOR

CROSS-REFERENCES TO RELATED APPLICATIONS

This non-provisional application claims priority under 35 U.S.C. §119(a) on Patent Application No. 103110939 and 104108694, filed in Taiwan, R.O.C. on 2014 Mar. 24 and 2015 Mar. 18, the entire contents of which are hereby incorporated by reference.

FIELD OF THE INVENTION

The instant disclosure relates to an electrical connector, and more particularly, to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use, from the end user's point of view. Now, as technology innovation marches forward, new kinds of devices, media formats and large inexpensive storage products are converging. They require significantly more bus bandwidth to maintain the interactive experience that users have come to expect. In addition, user applications demand a higher performance between the PC and sophisticated peripherals. The transmission rate of USB 2.0 is insufficient. Consequently, faster serial bus interfaces, such as USB 3.0, have been developed to address the need by adding a higher transmission rate to match usage patterns and devices.

A conventional USB electrical receptacle connector includes plate transmission terminals and a USB electrical plug connector includes elastic transmission terminals. When the conventional USB electrical receptacle connector with the conventional USB electrical plug connector in an improper orientation, the elastic transmission terminals or a tongue portion of the conventional USB electrical plug connector may be damaged or even broken, resulting in the disablement of the elastic transmission terminals or the tongue portion.

Furthermore, the surface of an iron shell of the conventional USB electrical receptacle connector or the surface of the conventional USB electrical plug connector is provided with a crack for firmly connection. However, these cracks would adversely influence the shielding effect of the iron shell to induce interferences (such as Electromagnetic Interference (EMI), Radio-Frequency Interference (RFI), and the like), with other signals during signal transmission. Therefore, a problem of serious crosstalk between the terminals of conventional connector is to be solved.

SUMMARY OF THE INVENTION

In view of the above-mentioned problems, the instant disclosure provides an electrical receptacle connector. The electrical receptacle connector comprises a metal shell, an insulation housing, a plurality of upper-row plate terminals, and a plurality of lower-row plate terminals. The metal shell defines a receptacle cavity therein. The insulation housing is located in the receptacle cavity and comprises a base portion and a tongue portion extending from one side of the base portion. The tongue portion comprises an upper surface and a lower surface. The upper-row plate terminals are held on the base portion and tongue portion and comprise a plurality of upper-row plate signal terminals, at least one upper-row plate power terminal, and at least one upper-row plate ground terminal. The upper-row plate terminals are on the upper surface. The lower-row plate terminals are held on the base portion and tongue portion and comprise a plurality of lower-row plate signal terminals, at least one lower-row plate power terminal, and at least one lower-row plate ground terminal. The lower-row plate terminals are on the lower surface. Wherein, the upper-row plate terminals are on the upper surface for transmitting first signals, the lower-row plate terminals are on the lower surface for transmitting second signals. The specification for transmitting the first signals is conformed to the specification for transmitting the second signals. The upper-row plate terminals and the lower-row plate terminals are point-symmetrical with a central point of the receptacle cavity as the symmetrical center.

In conclusion, since the upper-row plate terminals and the lower-row plate terminals are arranged upside down, and the pin assignment of the upper-row plate signal terminals is left-right reversal with respect to that of the lower-row plate signal terminals. When an electrical plug connector is inserted into the electrical receptacle connector by a first orientation where the upper plane of electrical plug connector is facing up, upper-row elastic terminals of the electrical plug connector are in contact with the upper-row plate signal terminals. Conversely, when the electrical plug connector is inserted into the electrical receptacle connector by a second orientation where the lower plane of the electrical plug connector is facing up, the upper-row elastic terminals of the electrical plug connector are in contact with the lower-row plate signal terminals. Consequently, the inserting orientation of the electrical plug connector is not limited when inserting into the electrical receptacle connector. Moreover, a plurality of hook structures is protruded on the two sides of the tongue portion. Therefore, when an electrical plug connector is inserted into the electrical receptacle connector, the elastic pins on two sides of the electrical plug connector would not wear against the two sides of the tongue portion. In addition, a grounding sheet is configured to the insulation housing and between the upper-row contact segment and the lower-row contact segment, thus the crosstalk interference can be improved by the grounding sheet during signal transmission. Furthermore, the structural strength of the tongue portion can be further enhanced.

Detailed description of the characteristics and the advantages of the instant disclosure is shown in the following embodiments, the technical content and the implementation of the instant disclosure should be readily apparent to any person skilled in the art from the detailed description, and the purposes and the advantages of the instant disclosure should be readily understood by any person skilled in the art with reference to content, claims and drawings in the disclosure.

BRIEF DESCRIPTION OF THE DRAWINGS

The disclosure will become more fully understood from the detailed description given herein below for illustration only, and thus are not limitative of the disclosure, and wherein:

FIG. 4B is a schematic configuration diagram of the plate terminals of the electrical receptacle connector shown in FIG. 4A;

DETAILED DESCRIPTION

Figure 1:
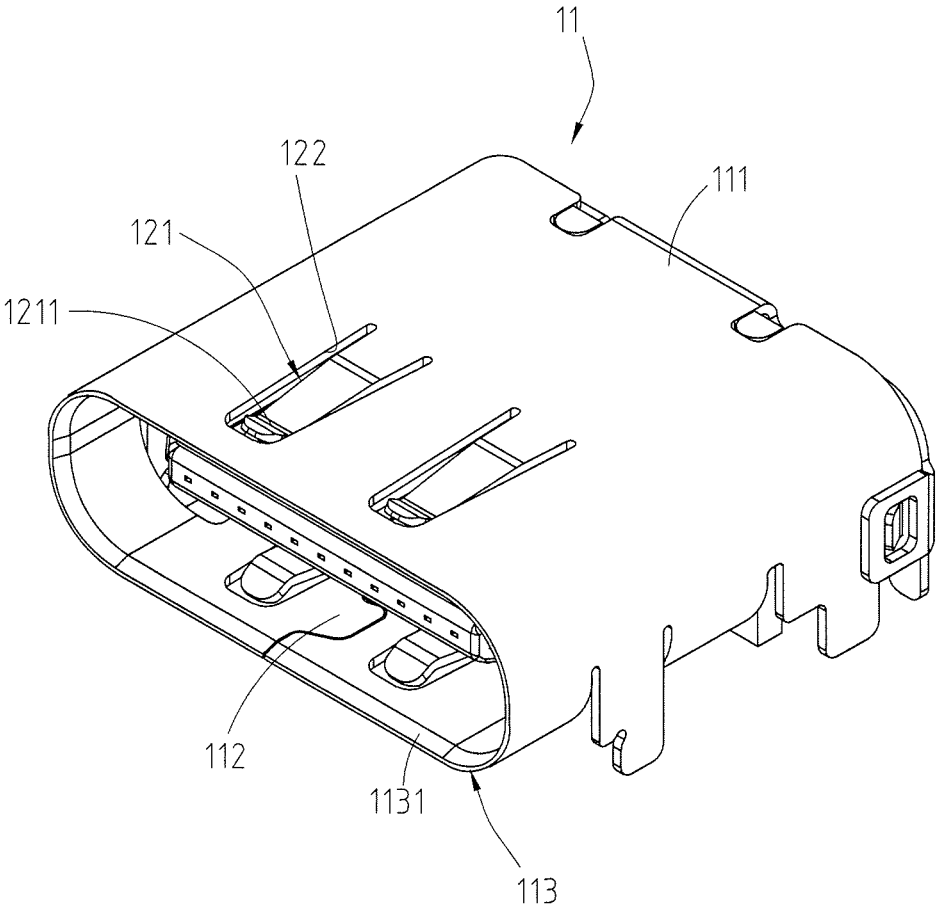
FIG. 1 illustrates a perspective view of an electrical receptacle connector according to the instant disclosure.
Figure 2:
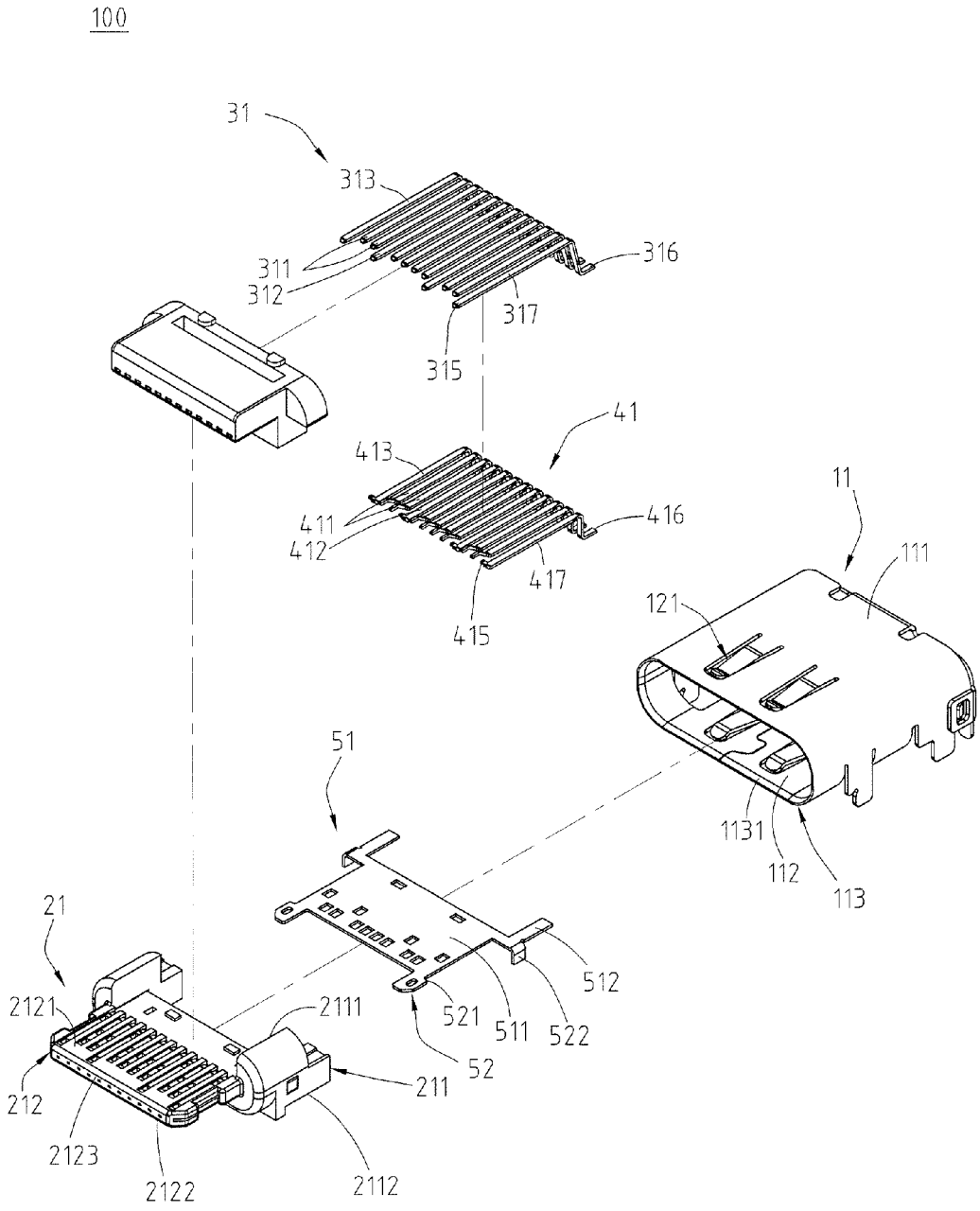
FIG. 2 illustrates an exploded view of the electrical receptacle connector according to the instant disclosure.
Figure 3:
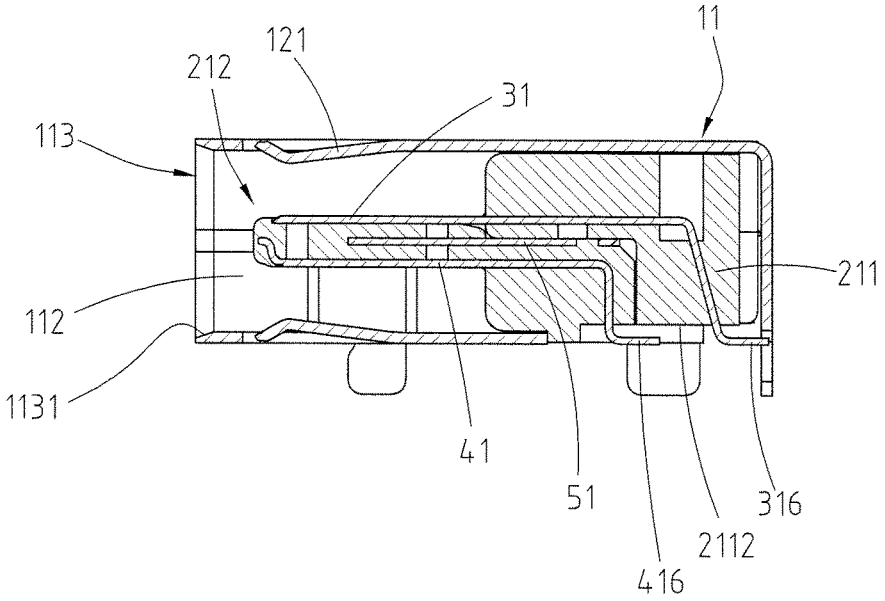
FIG. 3 illustrates a cross-sectional view of the electrical receptacle connector according to the instant disclosure.

Please refer to FIG. 1, FIG. 2, and FIG. 3, illustrating exemplary embodiments of an electrical receptacle connector 100 according to the instant disclosure. FIG. 1 is a perspective view, FIG. 2 is an exploded view, and FIG. 3 is a cross-sectional view of the electrical receptacle connector 100. The electrical receptacle connector 100 according to the instant disclosure is in accordance with the specification of a USB Type-C connection interface. In the embodiment, the electrical receptacle connector 100 mainly comprises a metal shell 11, an insulation housing 21, a plurality of upper-row plate terminals 31, and a plurality of lower-row plate terminals 41.

Figure 5:
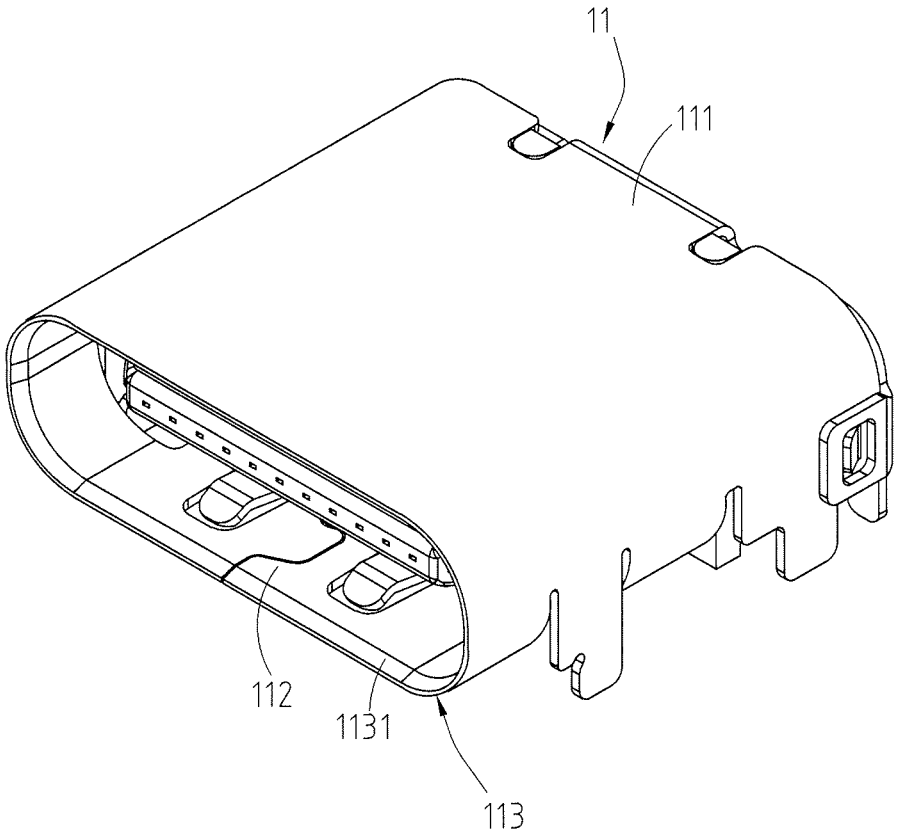
FIG. 5 illustrates a perspective view of a metal shell of the electrical receptacle connector according to the instant disclosure.
Figure 6:
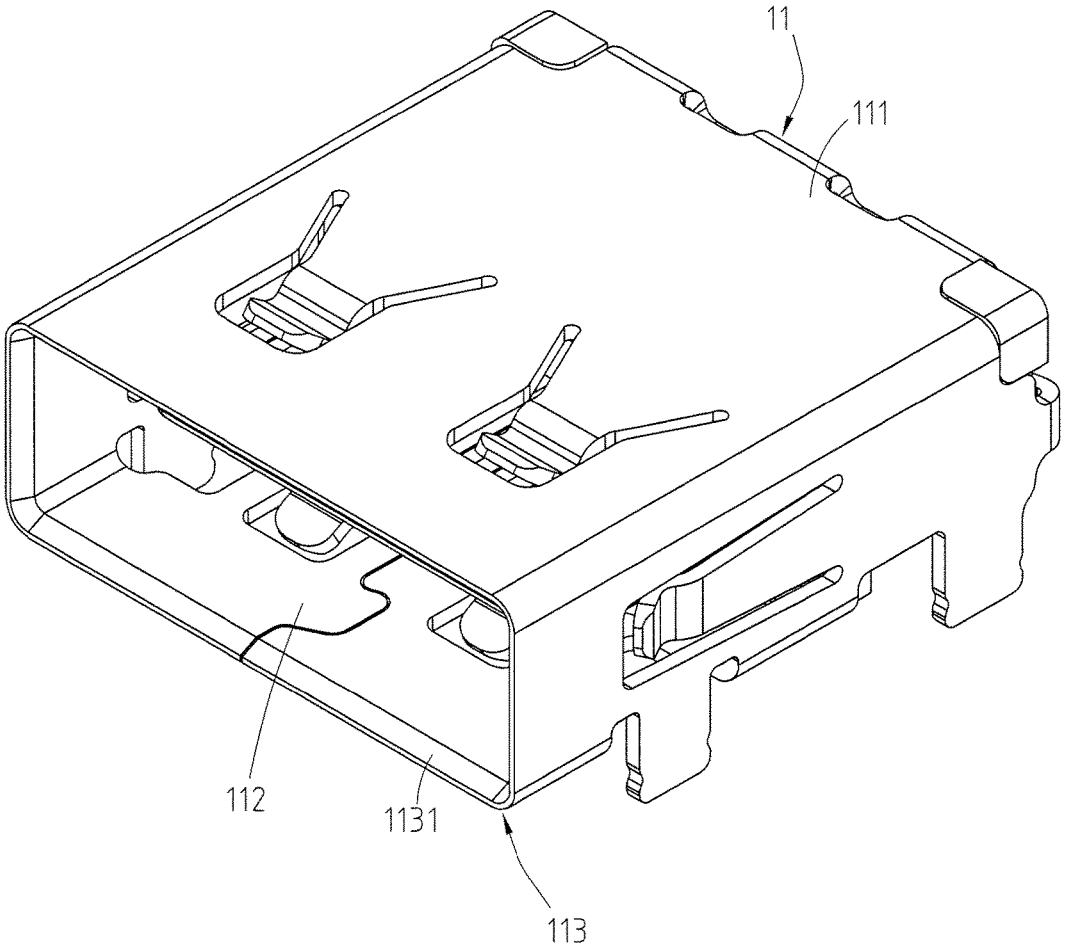
FIG. 6 illustrates a perspective view of a metal shell of the electrical receptacle connector according to the instant disclosure, for one variation.
Figure 20:
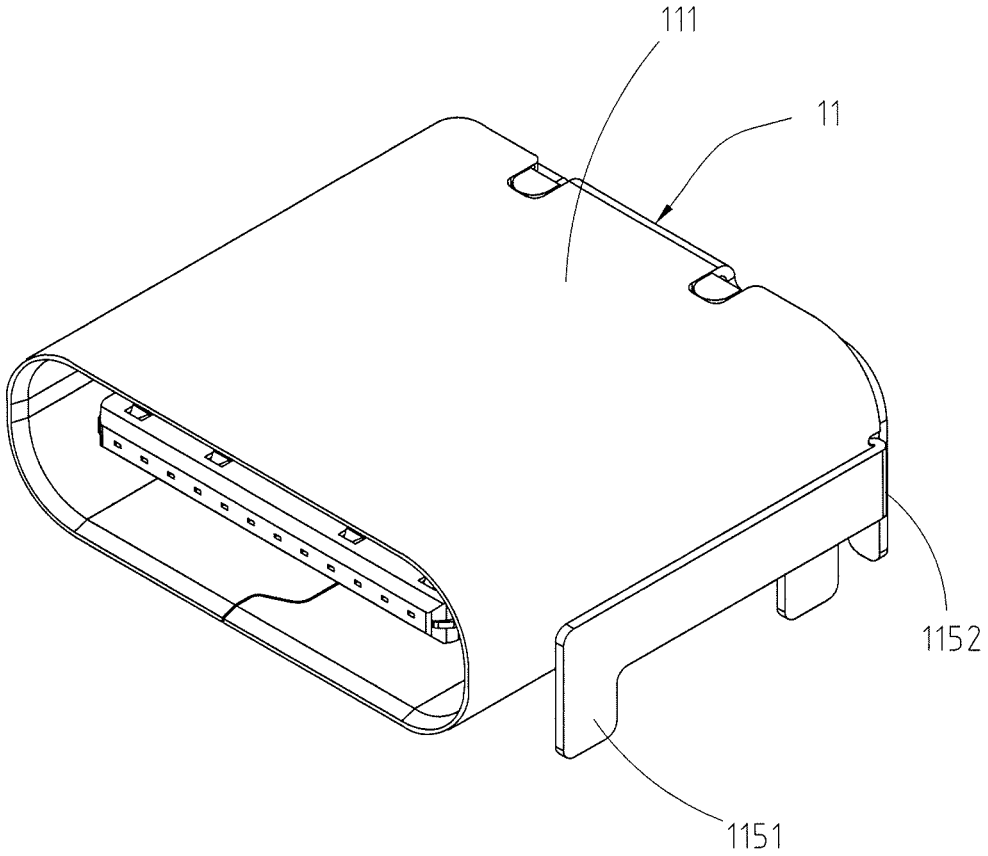
FIG. 20 illustrates a perspective view of the metal shell of the electrical receptacle connector according to the instant disclosure, where the metal shell is combined with a reversely-folded grounding piece.

The metal shell 11 is a hollow shell and defines a receptacle cavity 112 therein. In the embodiment, the metal shell 11 can be formed by bending a unitary structure. In addition, the metal shell 11 may be provided with an elastic sheet 121 and a crack 122 (as shown in FIG. 1). Alternatively, the metal shell 11 may be devoid of the elastic sheet 121 and the crack 122 (as shown in FIG. 5 and FIG. 20). In the other words, the metal shell 11 could be a seamless shell. An insertion opening, in oblong shaped, is formed on one side of the metal shell 11 (as shown in FIG. 1). Alternatively, an insertion opening 113, in rectangular shaped, is formed on one side of the metal shell 11 (as shown in FIG. 6). In addition, the insertion opening 113 communicates with the receptacle cavity 112.

The insulation housing 21 is in the receptacle cavity 112 and mainly comprises a base portion 211 and a tongue portion 212. The base portion 211 and the tongue portion 212 described herein are formed by injection-molding. The tongue portion 212 is extending from one side of the base portion 211 and has an upper surface 2121, a lower surface 2122, and a front lateral surface 2123.

Figure 4A:
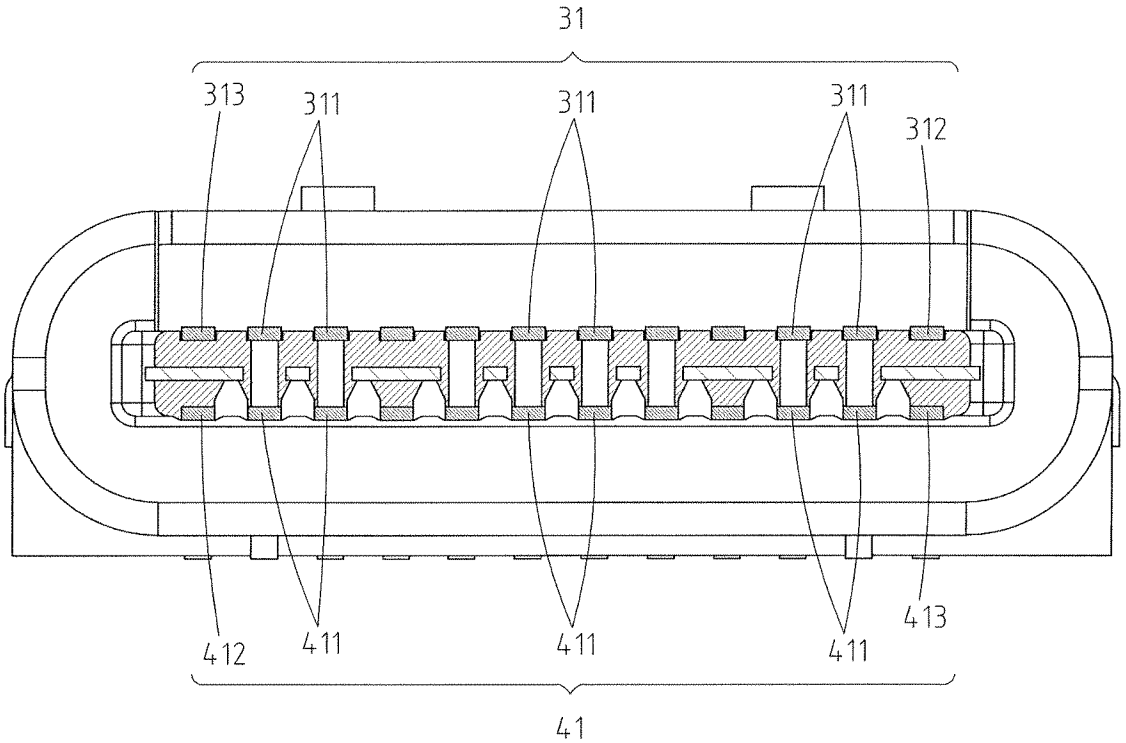
FIG. 4A illustrates a front sectional view of the electrical receptacle connector according to the instant disclosure.
Figure 12A:
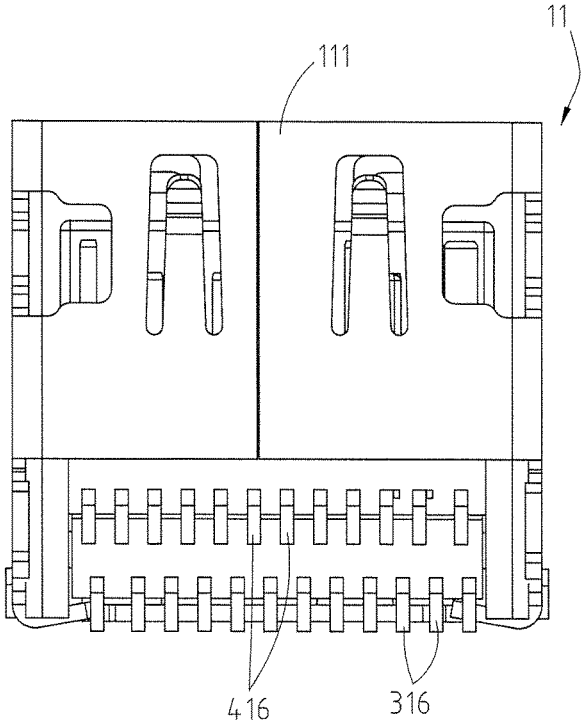
FIG. 12A is a top view illustrating that the upper-row plate terminals are offset with respect to the lower-row plate terminals of the electrical receptacle connector according to the instant disclosure.
Figure 12B:
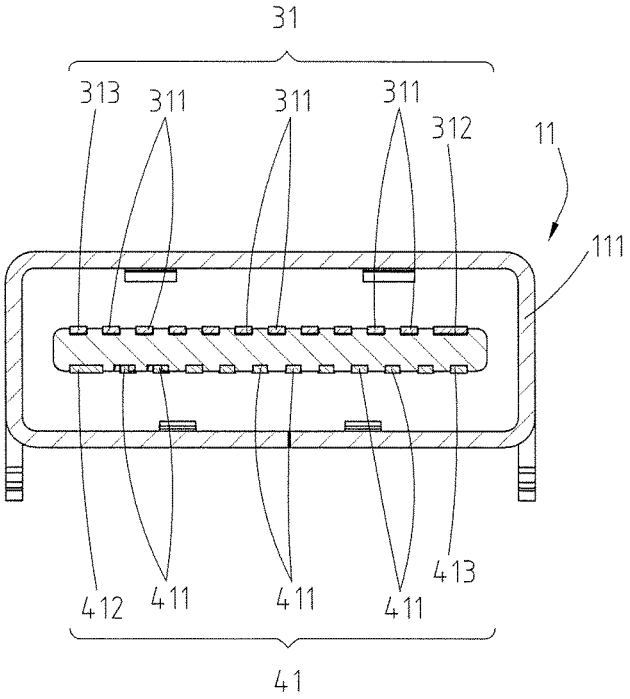
FIG. 12B is a front sectional view illustrating that the upper-row plate terminals are offset with respect to the lower-row plate terminals of the electrical receptacle connector according to the instant disclosure.
Figure 13:
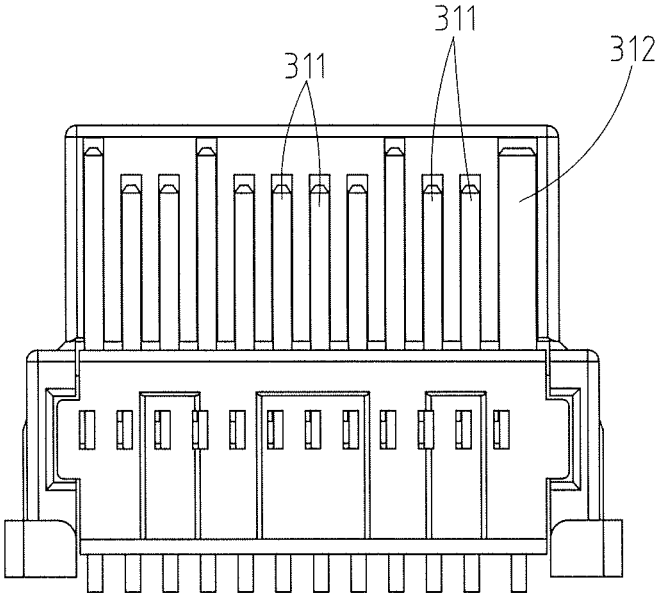
FIG. 13 is a top view illustrating an upper-row plate power terminal of the electrical receptacle connector according to the instant disclosure, for one variation.

Please refer to FIG. 4A and FIG. 4B, in which the upper-row plate terminals 31 comprise a plurality of upper-row plate signal terminals 311, at least one upper-row plate power terminal 312, and at least one upper-row plate ground terminal 313. As shown in FIG. 4B, the upper-row plate terminals 31 comprise, from left to right, an upper-row plate ground terminal 313 (Gnd), a first pair of differential signal terminals (TX1+−), a second pair of differential signal terminals (D+−), and a third pair of differential signal terminals (RX2+−), of the upper-row plate signal terminals 311, upper-row plate power terminals 312 (Power/VBUS), between the three pairs of differential signal terminals, a retain terminal (RFU), (the retain terminal and a configuration channel 1 (CC1) are respectively arranged between the upper-row plate power terminals 312 (Power/VBUS) and the second pair of differential signal terminals of the upper-row plate signal terminals 311, and an upper-row plate ground terminal 313 (Gnd) on the rightmost side. However, the pin assignment described herein is an example for illustrative purpose, but not a limitation. The electrical receptacle connector 100 described herein may comprise, but not limited to, twelve upper-row plate terminals 31 for transmitting USB 3.0 signals. In some embodiments, the rightmost (or leftmost) upper-row plate ground terminal 313 (Gnd) and the retain terminal (RFU) can be omitted. Besides, the rightmost upper-row plate ground terminal 313 (Gnd) may be replaced by an upper-row plate power terminal 313 (Power/VBUS) for power transmission. Here, the width of the upper-row plate power terminal 312 (Power/VBUS) described herein may be, but not limited to, be equal to the width of each of the upper-row plate signal terminals 311 (as shown in FIG. 4A). In some embodiments, the width of the upper-row plate power terminal 312 (Power/VBUS) may be greater than the width of each of the upper-row plate signal terminals 311 (as shown in FIG. 12B and FIG. 13). Accordingly, the electrical receptacle connector 100 is applicable for an electronic product required for high current transmission.

Figure 11:
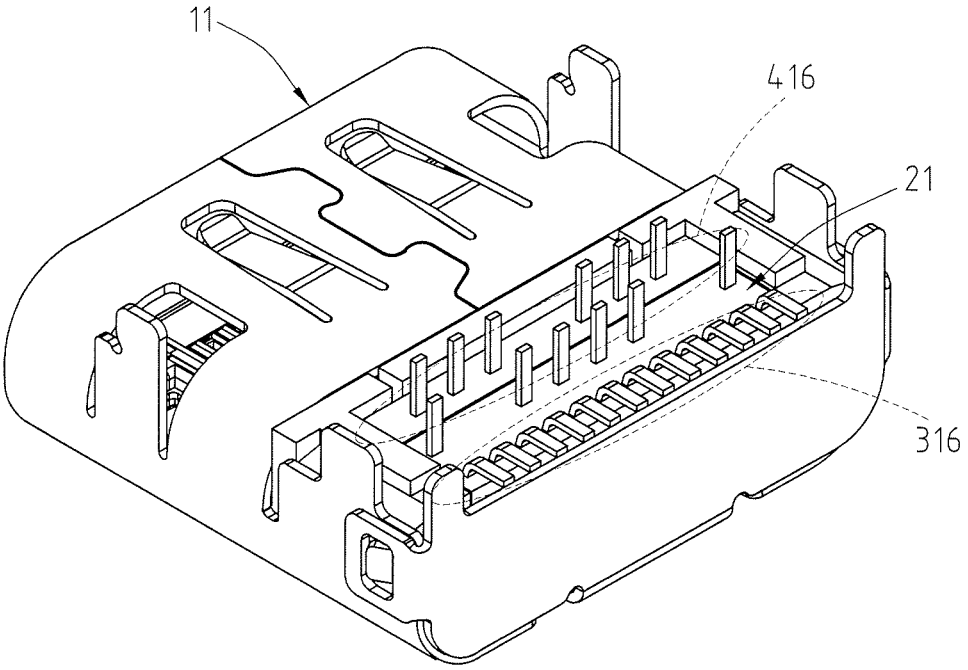
FIG. 11 is a perspective view illustrating a bottom surface of the electrical receptacle connector according to the instant disclosure, for one variation.

Please refer to FIG. 2 and FIG. 3, in which the upper-row plate terminals 31 are held on the base portion 211 and the tongue portion 212. Each of the upper-row plate terminals 31 comprises an upper-row contact segment 315, an upper-row connecting segment 317, and an upper-row soldering segment 316. For each upper-row plate terminal 31, the upper-row connecting segment 317 is in the base portion 211 and the tongue portion 212, the upper-row contact segment 315 is extending from one of two ends of the upper-row connecting segment 317 and on the upper surface 2121, and the upper-row soldering segment 316 is extending from the other end of the upper-row connecting segment 317 and protruded out of the base portion 211. The upper-row plate signal terminals 311 are on the upper surface 2121 for transmitting first signals (i.e., USB 3.0 signals). The upper-row soldering segments 316 are protruded out of a bottom surface 2112 of the base portion 211. Moreover, the upper-row soldering segments 316 are horizontally aligned and provided as pins, i.e. horizontal pins (as shown in FIG. 11).

Figure 9:
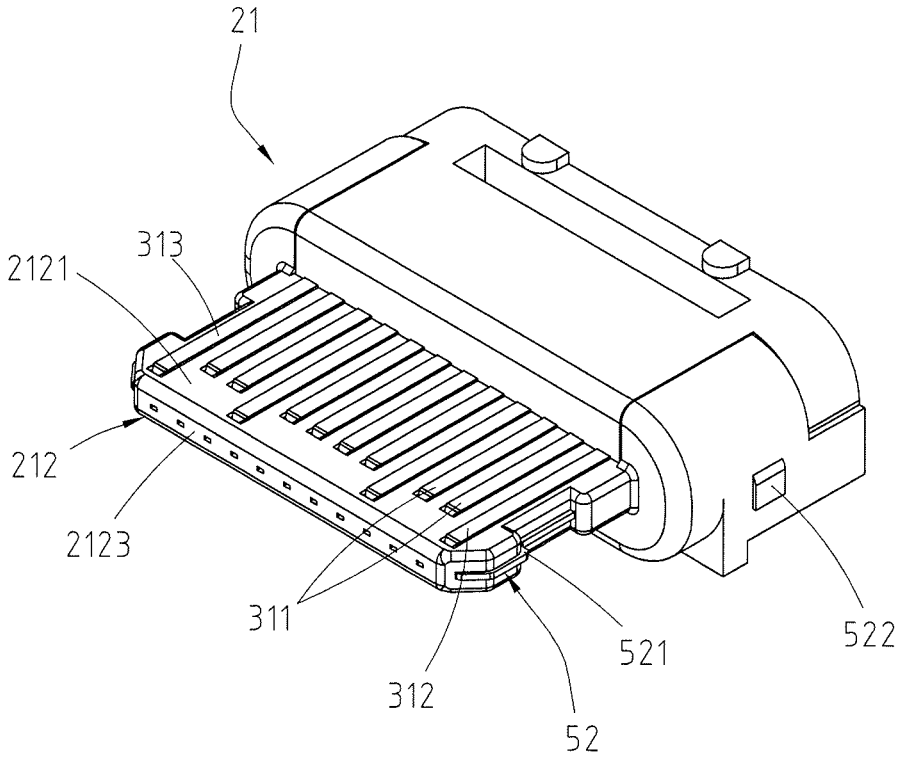
FIG. 9 illustrates a perspective view of the electrical receptacle connector according to the instant disclosure, where hook structures are combined to a tongue portion of the electrical receptacle connector.

Please refer to FIG. 2 and FIG. 9, in which embodiment the distance between the upper-row plate power terminal 312 and the front lateral surface 2123 of the tongue portion 212 is less than the distance between each of the upper-row plate signal terminals 311 and the front lateral surface 2123 of the tongue portion 212. In addition, the distance between the upper-row plate ground terminal 313 and the front lateral surface 2123 of the tongue portion 212 is less than the distance between each of the upper-row plate signal terminals 311 and the front lateral surface 2123 of the tongue portion 212. When an electrical plug connector is plugged into the electrical receptacle connector 100, the upper-row plate power terminal 312 or the upper-row plate ground terminal 313 is preferentially in contact with the terminals of the electrical plug connector, and the upper-row plate signal terminals 311 are then in contact with the terminals of the electrical plug connector. Accordingly, the electrical plug connector is ensured to be completely plugged into the electrical receptacle connector 100 (i.e., to be plugged into the electrical receptacle connector 100 properly), before power or signal transmission. It should be understood that if the electrical plug connector is not completely plugged into the electrical receptacle connector 100, arc burn may occur due to poor contact between the upper-row plate signal terminals 311 and the terminals of the electrical plug connector. Therefore, based on the upper-row plate terminals 31 with different lengths, the arc burn problem can be prevented.

Alternatively, in some embodiments, the upper-row plate terminals 31 may have an identical length. That is, the distance between the upper-row plate power terminal 312 and the front lateral surface 2123 of the tongue portion 212 is equal to the distance between each of the upper-row plate signal terminals 311 and the front lateral surface 2123 of the tongue portion 212, and the distance between the upper-row plate ground terminal 313 and the front lateral surface 2123 of the tongue portion 212 is equal to the distance between each of the upper-row plate signal terminals 311 and the front lateral surface 2123 of the tongue portion 212.

Referring to FIGS. 4A and 4B, the lower-row plate terminals 41 includes a plurality of lower-row plate signal terminals 411, a lower-row plate power terminal 412, and a lower-row plate ground terminal 413. As shown in FIG. 4B, the lower-row plate terminals 41 comprise, from right to left, a lower-row plate ground terminal 411 (Gnd), a first pair of differential signal terminals (TX2+−), a second pair of differential signal terminals (D+−), and a third pair of differential signal terminals (RX1+−), of the lower-row plate signal terminals 411, lower-row plate power terminals 412 (Power/VBUS), between the three pairs of differential signal terminals, a retain terminal (RFU), (the retain terminal and a configuration channel 2 (CC2) are respectively arranged between the lower-row plate power terminals 412 (Power/VBUS) and the second pair of differential signal terminals of the lower-row plate signal terminals 411), and a lower-row plate ground terminal (Gnd) on the leftmost side. However, the pin assignment described herein is an example for illustrative purpose, but not a limitation. The electrical receptacle connector 100 described herein, may include, but not limited to, twelve lower-row plate terminals 41 for transmitting the USB 3.0 signals. In some embodiments, the rightmost (or leftmost) lower-row plate ground terminal 413 (Gnd) and the retain terminal (RFU) can be omitted. Besides, the leftmost lower-row plate ground terminal 413 (Gnd) may be replaced by a lower-row plate power terminal 412 (Power/VBUS) for power transmission. Here, the width of the lower-row plate power terminal 412 (Power/VBUS) described herein may be, but not limited to, be equal to the width of each of the lower-row plate signal terminals (as shown in FIG. 2). In some embodiments, the width of the lower-row plate power terminal 412 (Power/VBUS) may be greater than the width of each of the lower-row plate signal terminals (as shown in FIG. 12B). Accordingly, the electrical receptacle connector 100 is applicable for the electronic product required for high current transmission.

Figure 10:
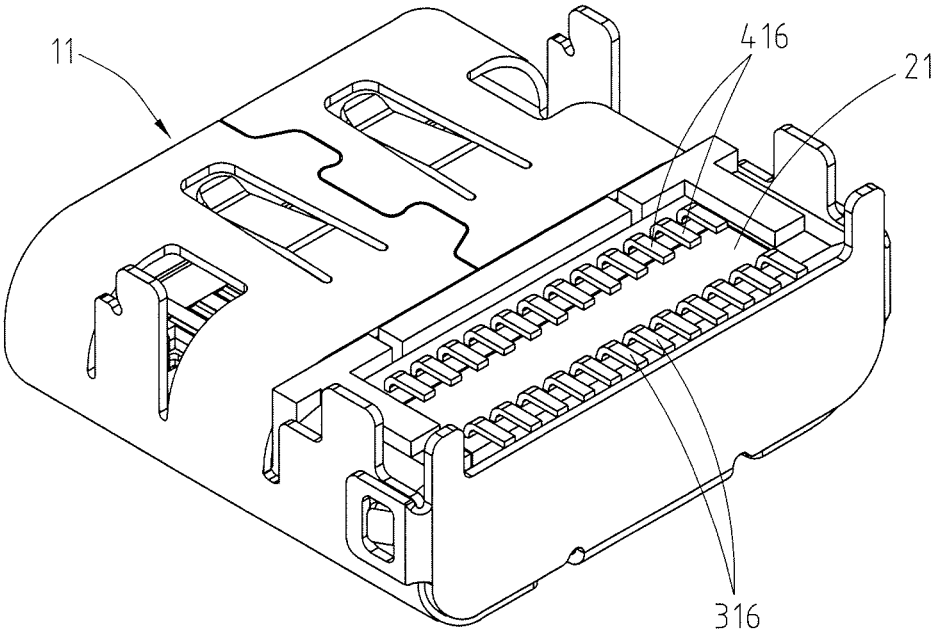
FIG. 10 is a perspective view illustrating a bottom surface of the electrical receptacle connector according to instant disclosure.

Please refer to FIG. 2 and FIG. 3, in which the lower-row plate terminals 41 are held on the base portion 211 and the tongue portion 212. Each of the lower-row plate terminals 41 comprises a lower-row contact segment 415, a lower-row connecting segment 417, and a lower-row soldering segment 416. For each lower-row plate terminal 41, the lower-row connecting segment 417 is held in the base portion 211 and the tongue portion 212, the lower-row contact segment 415 is extending from one of two ends of the lower-row connecting segment 417 and on the lower surface 2122, and the lower-row soldering segment 416 is extending from the other end of the lower-row connecting segment 417 and protruded out of the base portion 211. The lower-row plate signal terminals 411 are on the lower surface 2122 for transmitting second signals (i.e., USB 3.0 signals). The lower-row soldering segments 416 are protruded out of the bottom surface 2112 of the base portion 211. Moreover, the lower-row soldering segments 316 are horizontally aligned and provided as pins, i.e. horizontal pins (as shown in FIG. 10). Alternatively, the lower-row soldering segments 416 may be extended vertically and provided as pins, i.e. vertical pins (as shown in FIG. 11).

Please refer back to FIG. 2, FIG. 3, FIG. 4A and FIG. 4B, in which embodiment the upper-row plate terminals 31 and the lower-row plate terminals 41 are respectively on the upper surface 2121 and the lower surface 2122 of the tongue portion 212. Additionally, pin assignment of the upper-row plate terminals 31 and the lower-row plate terminals 41 are point-symmetrical with a central point of the receptacle cavity 112 as the symmetrical center. Here, point-symmetry means that after the upper-row plate terminals 31 (or the lower-row plate terminals 41), are rotated by 180 degrees with the symmetrical center as the rotating center, the upper-row plate terminals 31 and the lower-row plate terminals 41 are overlapped. That is, the rotated upper-row plate terminals 31 are arranged at the position of the original lower-row plate terminals 41, and the rotated lower-row plate terminals 41 are arranged at the position of the original upper-row plate terminals 31. In other words, the upper-row plate terminals 31 and the lower-row plate terminals 41 are arranged upside down, and the pin assignment of the upper-row plate terminals 31 are left-right reversal with respect to the pin assignment of the lower-row plate terminals 41. An electrical plug connector is inserted into the electrical receptacle connector 100 with a first orientation where the upper plane of electrical plug connector is facing up for transmitting first signals. Conversely, the electrical plug connector is inserted into the electrical receptacle connector 100 with a second orientation where the lower plane of the electrical plug connector is facing up for transmitting second signals. Besides, the specification for transmitting the first signals is conformed to the specification for transmitting the second signals. Note that, the inserting orientation of the electrical plug connector is not limited by the electrical receptacle connector 100 according to the instant disclosure.

Please refer to FIG. 2, FIG. 3, and FIG. 4A, in which embodiment, the position of the upper-row plate terminal 31 corresponds to the position of the lower-row plate terminals 41, as shown in FIG. 4A. Please refer to FIG. 2 and FIG. 7, in which embodiment, the distance between the lower-row plate power terminal 412 and the front lateral surface 2123 of the tongue portion 212 is less than the distance between each of the lower-row plate signal terminals 411 and the front lateral surface 2123 of the tongue portion 212. In addition, the distance between the lower-row plate ground terminal 413 and the front lateral surface 2123 of the tongue portion 212 is less than the distance between each of the lower-row plate signal terminals 411 and the front lateral surface 2123 of the tongue portion 212. When the electrical plug connector is plugged into the electrical receptacle connector 100, the lower-row plate power terminal 412 or the lower-row plate ground terminal 413 is preferentially in contact with the terminals of the electrical plug connector, and the lower-row plate signal terminals 411 are then in contact with the terminals of the electrical plug connector. Accordingly, the electrical plug connector is ensured to be completely plugged into the electrical receptacle connector 100 (i.e. to be plugged into the electrical receptacle connector 100 properly), before power or signal transmission. It should be understood that if the electrical plug connector is not completely plugged into the electrical receptacle connector 100, arc burn may occur due to poor contact between the lower-row plate signal terminals 413 and the terminals of the electrical plug connector. Therefore, based on the lower-row plate terminals 41 with different lengths, the arc burn problem can be prevented.

Alternatively, in some embodiments, the lower-row plate terminals 41 may have an identical length. That is, the distance between the lower-row plate power terminal 412 and the front lateral surface 2123 of the tongue portion 212 is equal to the distance between each of the lower-row plate signal terminals 411 and the front lateral surface 2123 of the tongue portion 212, and the distance between the lower-row plate ground terminal 413 and the front lateral surface 2123 of the tongue portion 212 is equal to the distance between each of the lower-row plate signal terminals 411 and the front lateral surface 2123 of the tongue portion 212.

Figure 24:
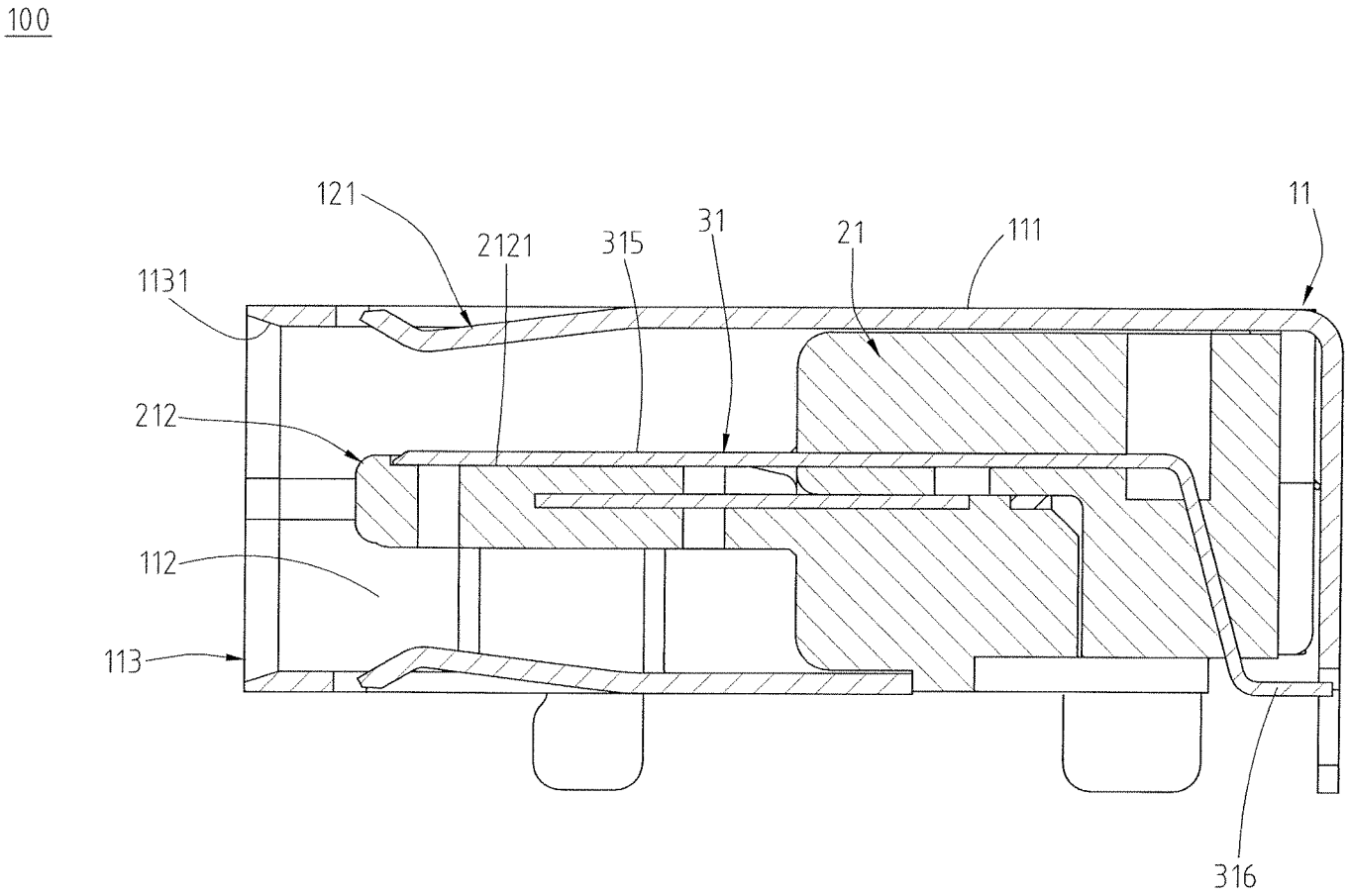
FIG. 24 illustrates a cross-sectional view of the electrical receptacle connector devoid of lower-row plate terminals.
Figure 25:
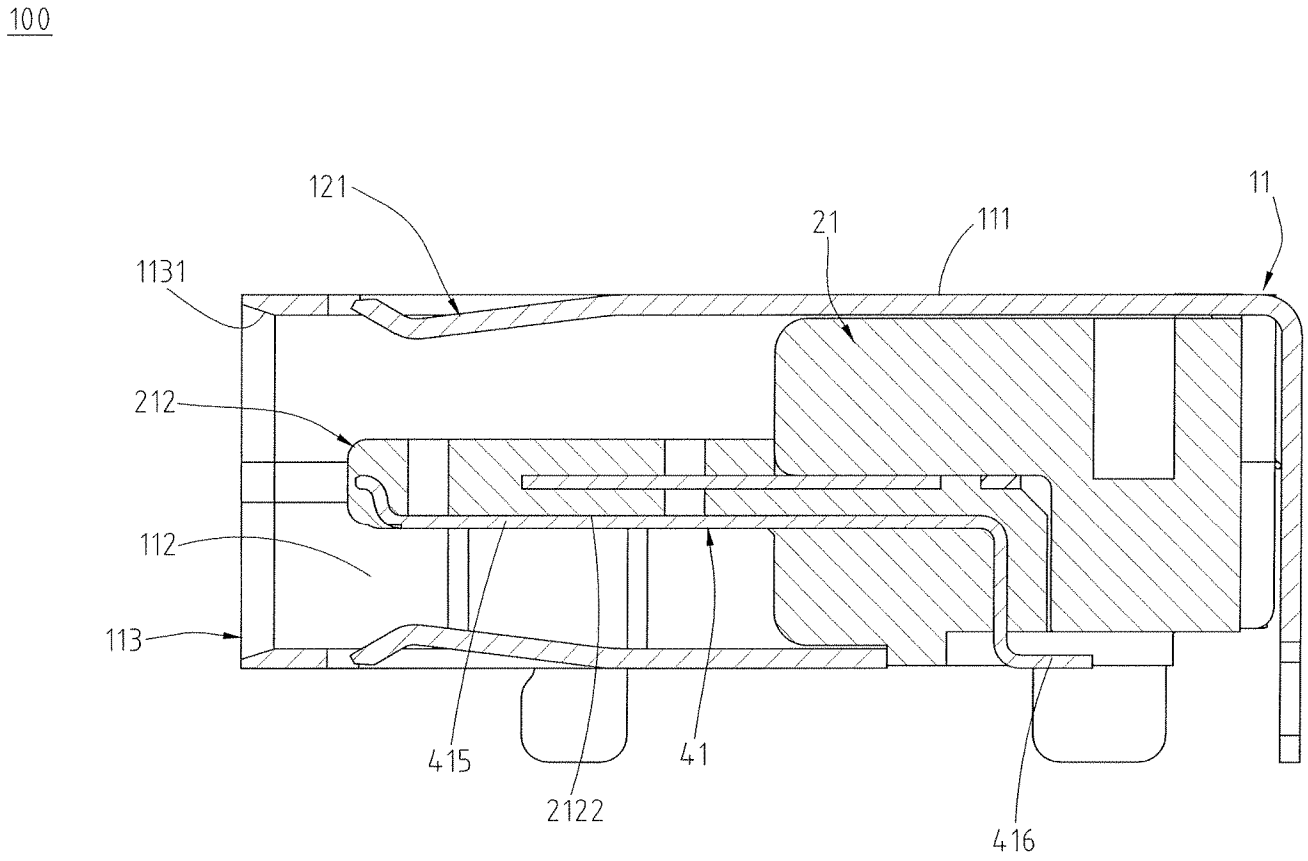
FIG. 25 illustrates a cross-sectional view of the electrical receptacle connector devoid of upper-row plate terminals.

Furthermore, in some embodiments, when an electrical plug connector is provided with plural upper-row terminals and lower-row terminals, the electrical receptacle connector 100 may be devoid of the upper-row plate terminals 31 or the lower-row plate terminals 41 (as shown in FIG. 24 and FIG. 25). Regarding the upper-row plate terminals 31 are omitted, when the electrical plug connector is plugged into the electrical receptacle connector 100 with the first orientation or the second orientation, the lower-row plate terminals 41 are in contact with the upper-row terminals or the lower-row terminals of the electrical plug connector. Conversely, regarding the lower-row plate terminals 41 are omitted, when the electrical plug connector is plugged into the electrical receptacle connector 100 with the first orientation or the second orientation, the lower-row plate terminals 41 are in contact with the upper-row terminals or the lower-row terminals of the electrical plug connector. Accordingly, the inserting orientation of the electrical plug connector is not limited by the orientation of the electrical receptacle connector 100 according to the instant disclosure.

Please refer to FIG. 10, in which embodiment, the upper-row soldering segments 316 and the lower-row soldering segments 416 are protruded out of the base portion 211 to be arranged separately. The upper-row soldering segments 316 and the lower-row soldering segments 416 may be, but not limited to, arranged into two parallel lines, one by one. Alternatively, the lower-row soldering segments 416 may be arranged into two lines, where the first line and the second line of the lower-row soldering segments 416 does not completely correspond to each other (as shown in FIG. 11), and the two lines are further accompany with a single row of the upper-row soldering segments 316 to form three rows.

Please refer to FIG. 2 and FIG. 4A, in which embodiment, the position of the upper-row plate terminal 31 corresponds to the position of the lower-row plate terminals 41, as shown in FIG. 4A. In other words, in the embodiment, the upper-row contact segments 315 are aligned to the lower-row contact segments 415, one by one, but embodiments are not thus limited. In some embodiments, the upper-row contact segments 315 are aligned parallel to the lower-row contact segments 415, and the upper-row contact segments 315 are offset with respect to the lower-row contact segments 415 (as shown in FIG. 12B). Similarly, the upper-row soldering segments 316 may be aligned with the lower-row soldering segments 416, one by one. Alternatively, the upper-row soldering segments 316 may be offset with respect to the lower-row soldering segments 416 (as shown in FIG. 12A).

Therefore, crosstalk interference can be effectively improved with the offset configuration between the contact segments 315, 415 during signal transmission. Particularly, regarding the upper-row plate terminals 31 and the lower-row plate terminals 41 are configured with an offset, the terminals of the electrical plug connector would have to be configured correspondingly (i.e., the upper-row terminals and the lower-row terminals of the electrical plug connector are configured with an offset). Thus, the upper-row terminals and the lower-row terminals of the electrical plug connector can be correspondingly in contact with the upper-row plate terminals 31 and the lower-row plate terminals 41 for power or signal transmission.

In the above embodiments, the upper-row plate terminals 31 and the lower-row plate terminals 41 may be, but not limited to, provided for transmitting the USB 3.0 signals, individually. In some embodiments, for the upper-row plate terminals 31, the first pair of differential signal terminals (TX1+−) and the third pair of differential signal terminals (RX2+−) of the upper-row plate signal terminals 311 can be omitted, and the second pair of differential signal terminals (D+−) and the upper-row plate power terminals 312 (Power/VBUS) are retained, when transmitting USB 2.0 signals. For the lower-row plate terminals 41, the first pair of differential signal terminals (TX2+−) and the third pair of differential signal terminals (RX1+−) of the lower-row plate signal terminals 411 can be omitted, and the second pair of differential signal terminals (D+−) and the lower-row plate power terminals 412 (Power/VBUS), when transmitting the USB 2.0 signals.

Figure 7:
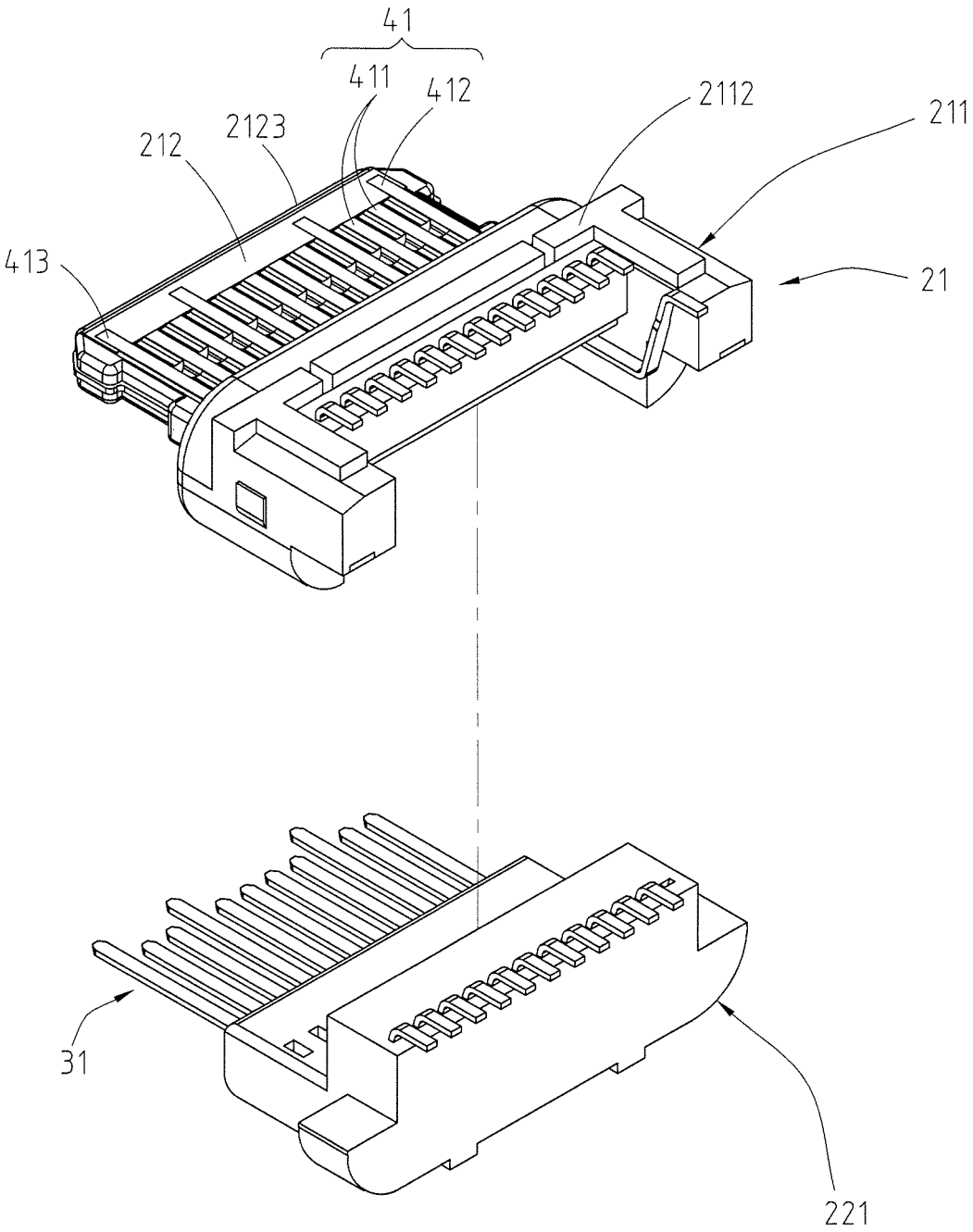
FIG. 7 illustrates an exploded view of an insulation housing of the electrical receptacle connector according to the instant disclosure.
Figure 8:
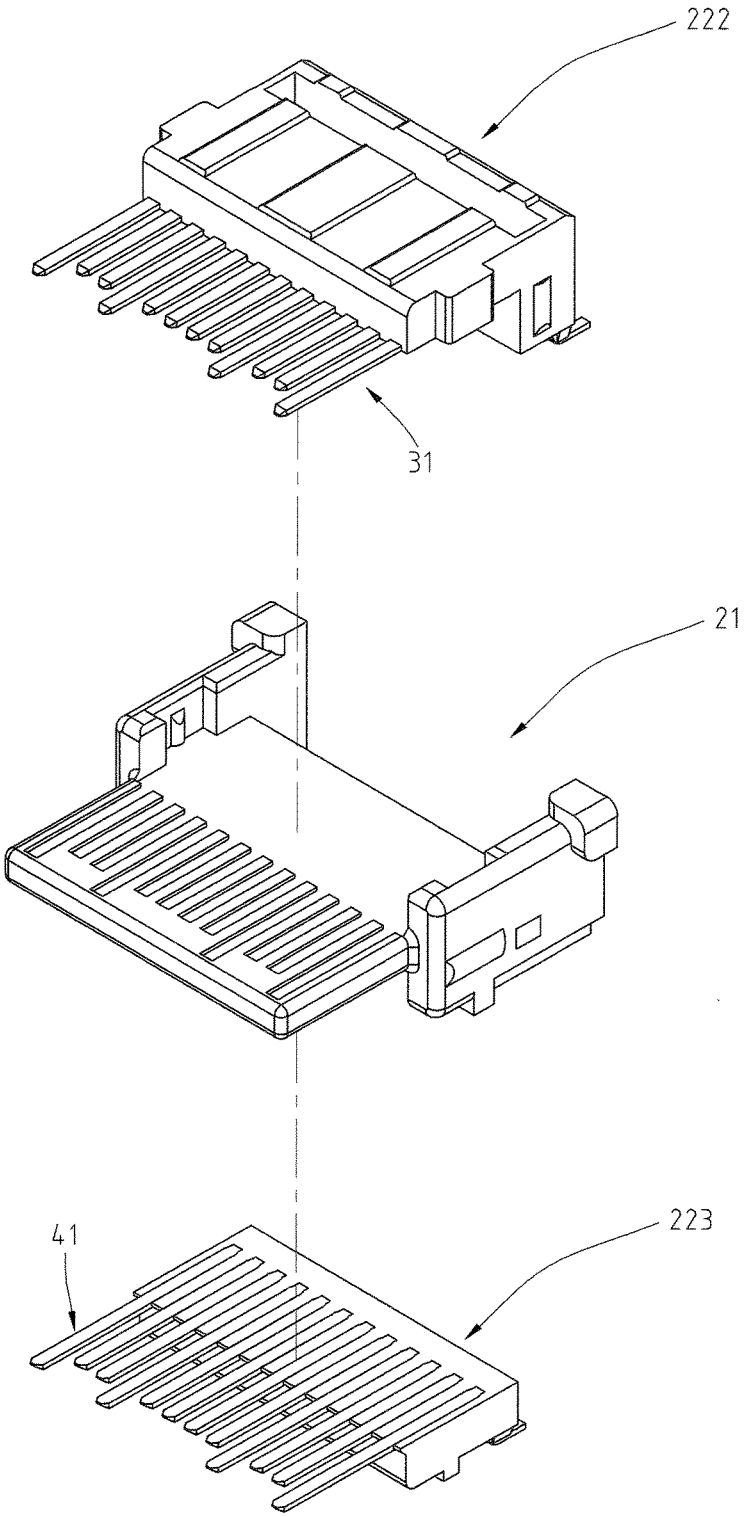
FIG. 8 illustrates an exploded view of an insulation housing of the electrical receptacle connector according to the instant disclosure, for one variation.

Please refer to FIG. 7. In some embodiments, the insulation housing 21 may be formed by a two-piece structure. Here, the insulation housing 21 further comprises a first mount 221. The first mount 221 is combined with the upper-row plate terminals 31 via insert-molding technique, the base portion 211 is combined with the lower-row plate terminals 41 via insert-molding technique, and then the first mount 221 is fixed on the base portion 211, but embodiments are not limited thereto. In some embodiments, the insulation housing 21 may be formed by a three-piece structure (shown in FIG. 8). Here, the insulation housing 21 may comprise a second mount 222 and a third mount 223. The second mount 222 is combined with the upper-row plate terminals 31 via insert-molding technique, and then the second mount 222 is further combined with a top surface 2111 of the base portion 211. The third mount 223 is combined with the lower-row plate terminals 41 via insert-molding technique, and then the third mount 223 is further combined with a bottom surface 2111 of the base portion 211.

Figure 22:
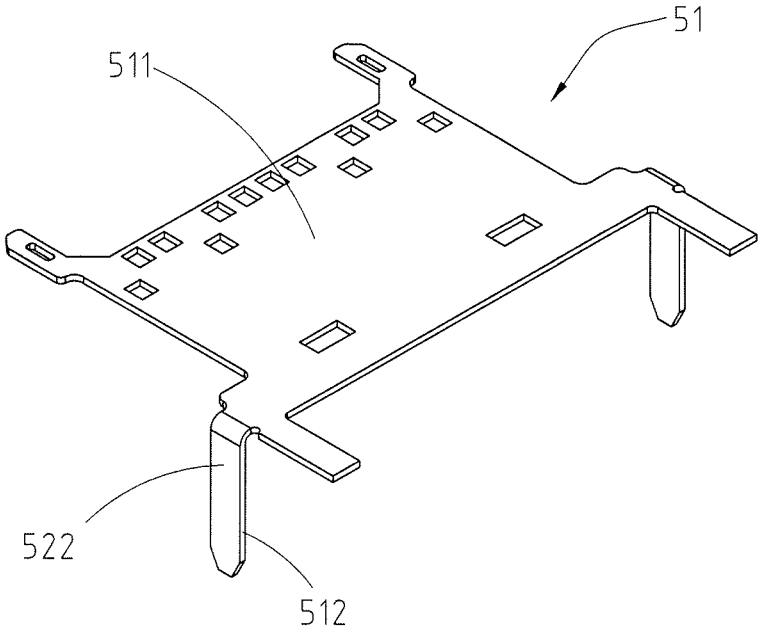
FIG. 22 illustrates a perspective view of a grounding sheet of the electrical receptacle connector according to the instant disclosure.
Figure 23:
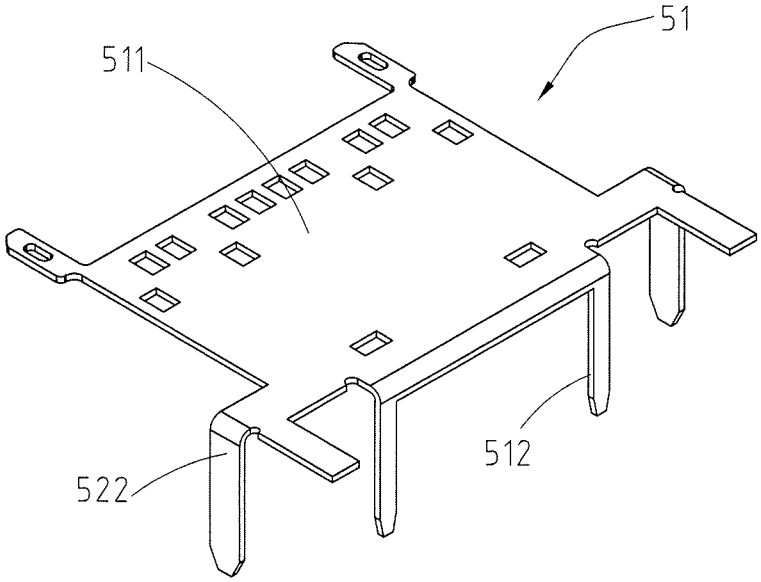
FIG. 23 illustrates a perspective view of a grounding sheet of the electrical receptacle connector according to the instant disclosure, for one variation.

Please refer to FIG. 2 and FIG. 3. In some embodiments, the electrical receptacle connector 100 is further provided with a grounding sheet 51 held in the insulation housing 21. The grounding sheet 51 comprises a body portion 511 and a plurality of pins 512. The body portion 511 is arranged between the upper-row contact segments 315 and the lower-row contact segments 415. In other words, the body portion 511 is formed between the base portion 211 and the tongue portion 212 and located between the upper-row contact segments 315 and the lower-row contact segments 415. In addition, the pins 512 may be, but not limited to, extending from two sides of the rear part of the body portion 511, protruded backward, and aligned horizontally. Alternatively, the pins 512 may be exposed out of the rear part of the base portion 211 to be in contact with the metal shell 11 or a circuit board. Accordingly, the crosstalk interference can be improved due to the grounding sheet 51 between the upper-row plate terminals 31 and the lower-row plate terminals 41 during signal transmission. In the other words, the grounding sheet 51 is also a shielding plate. Besides, the structural strength of the tongue portion 212 can be improved with the configuration of the grounding sheet 51 on the tongue portion 212. Additionally, the pins 512 may be located on the two sides of the body portion 511 and extending downward and vertically to be pins, i.e., vertical pins (as shown in FIG. 22). Therefore, pins 512 are exposed out of the two sides of the base portion 211 and in contact with the circuit board, and the outer surfaces of the pins 512 are in contact with the inner wall of the metal shell 11 by laser soldering or common soldering. Alternatively, in some embodiments, the pins 512 may be located at the rear part of the body portion 511 and extending downward and vertically to be pins, i.e., vertical pins (as shown in FIG. 23). Therefore, the pins 512 are exposed out of the rear part of the base portion 211 and in contact with the circuit board.

Please refer to FIG. 2 and FIG. 9. In some embodiments, the electrical receptacle connector 100 is further provided with a plurality of hook structures 52 located on the two sides of the insulation housing 21. The hook structures 52 and the grounding sheet 51 may be formed as a unitary structure or a multi-piece structure. Each of the hook structures 52 comprises a projecting engaging portion 521 and a projecting abutting portion 522. The projecting engaging portions 521 are extending from two sides of the front part of the body portion 511 and protruded from the two sides of the tongue portion 212. The projecting abutting portions 522 are extending from the two sides of the rear part of the body portion 511 and protruded from the two sides of the base portion 211 to be in contact with the metal shell 11. Specifically, the projecting abutting portions 522 and the pins 512 may be integrated respectively, so that each projecting abutting portion 522 and each corresponding pin 512 are formed as an extending leg, as shown in FIG. 22. The extending legs are located on the two sides of the body portion 511 with the outer surfaces of the extending legs being in contact with the inner wall of the metal shell 11 by laser soldering or common soldering technique. Accordingly, when the electrical plug connector is plugged into the electrical receptacle connector 100, the projecting engaging portions 521 can be buckled with clamp structures located on the two sides of the electrical plug connector. Thus, the two sides of the tongue portion 212 are prevented from wearing against the clamp structures on the two sides of the electrical plug connector. Moreover, noises in the clamp structures can be grounded and conducted due to the projecting abutting portions 522 are in contact with the metal shell 11. Besides, the projecting abutting portions 522 and the metal shell 11 may be connected by welding or laser soldering. As shown in FIG. 23, the pins 512 are extended from the rear side of the body portion 511 and bent downwardly to contact with the circuit board. The projecting abutting portions 522 and the pins 512 respectively forms extending legs, and the projecting abutting portions 522 and the pins 512 are in contact with the circuit board, respectively.

Figure 15:
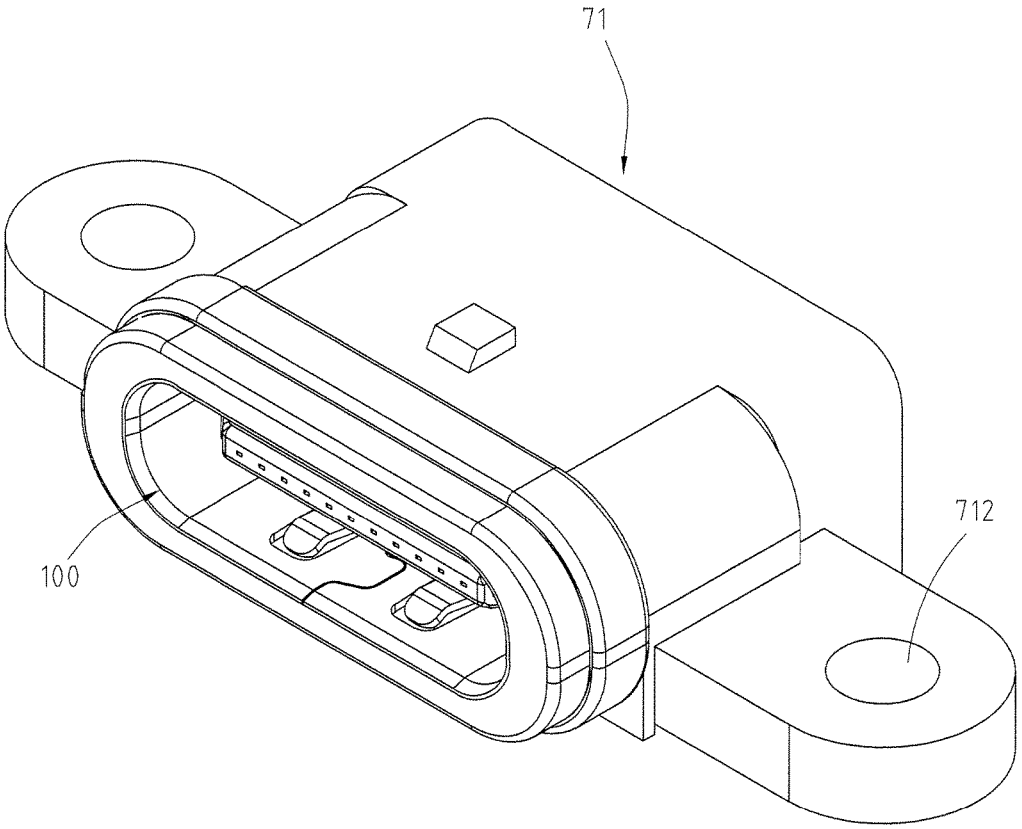
FIG. 15 illustrates a perspective view of the electrical receptacle connector combined with an insulation casing.
Figure 16:
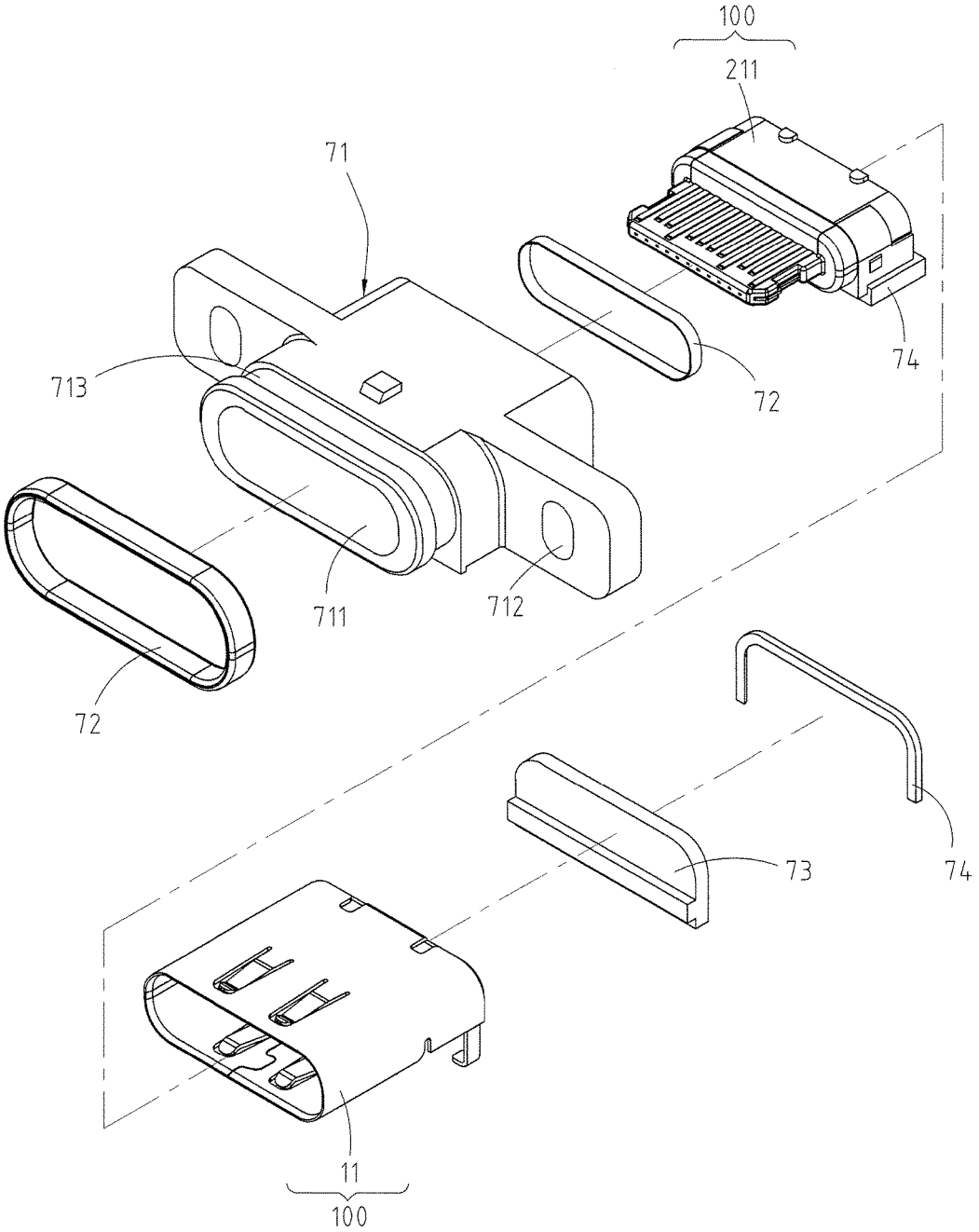
FIG. 16 illustrates an exploded view of the electrical receptacle connector combined with the insulation casing.

Please refer to FIG. 15 and FIG. 16. In some embodiments, the electrical receptacle connector is further provided with an insulation casing 71, a plurality of waterproof gaskets 72, a waterproof cover 73, and a sealing material 74. The insulation casing 71 is a hollow base made of plastic. The insulation casing 71 defines a hollow opening 711 therein. The metal shell 11 is accommodated in the insulation casing 71. Lock holes 712, aligned horizontally or vertically, are formed on two sides of the insulation casing 71. The waterproof gaskets 72 are assembled with at least one of the base portion 211 and the insulation casing 71. The waterproof gaskets 72 may be fitted over the base portion 211 or the insulation casing 71, alternatively, the waterproof gaskets 72 may be combined with the base portion 211 or the insulation casing 71 via insert-molding technique. Regarding the waterproof gaskets 72 are fitted over the base portion 211, the waterproof gaskets 72 are abutted against between the base portion 211 and the metal shell 11 so as to prevent moist from penetrating inside through the junction between the base portion 211 and the metal shell 11. Regarding the waterproof gaskets 72 are fitted over the insulation casing 71, the insulation casing 71 is provided with a recessed portion 713 defined at the outer periphery thereof for accommodating the waterproof gaskets 72. Therefore, when the insulation casing 71 is assembled to a shell of an electronic product, fixing elements (e.g., rivets or bolts) are provided into the lock holes 712 to secure the insulation casing 71 with the shell of the electronic product, and the waterproof gasket 72 configured between the shell of the electronic product and the insulation casing 71 prevent moist from penetrating inside through the junction between the shell of the electronic product and the insulation casing 71. The waterproof cover 73 covers the rear part of the insulation casing 71. In other words, the waterproof cover 73 covers the hollow opening 711. In addition, the space between the waterproof cover 73 and the hollow opening 711 may be, but not limited to, filled with the sealing material 74. In some embodiments, the sealing material 74 may be applied to completely seal the rear part of the metal shell 72; in other words, in the embodiments, the insulation casing 71 is devoid of the waterproof cover 73.

Figure 17:
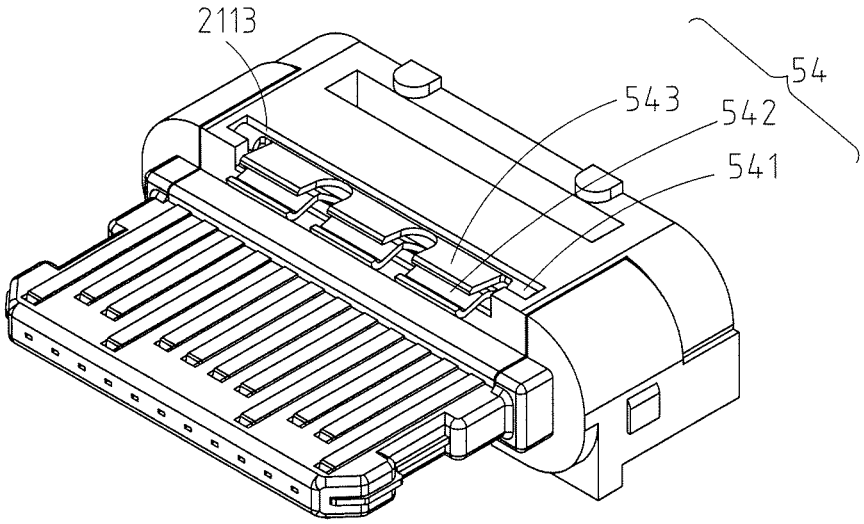
FIG. 17 is a perspective view illustrating the insulation housing of the electrical receptacle connector according to the instant disclosure, where conductive plates are combined with the insulation housing.
Figure 17A:
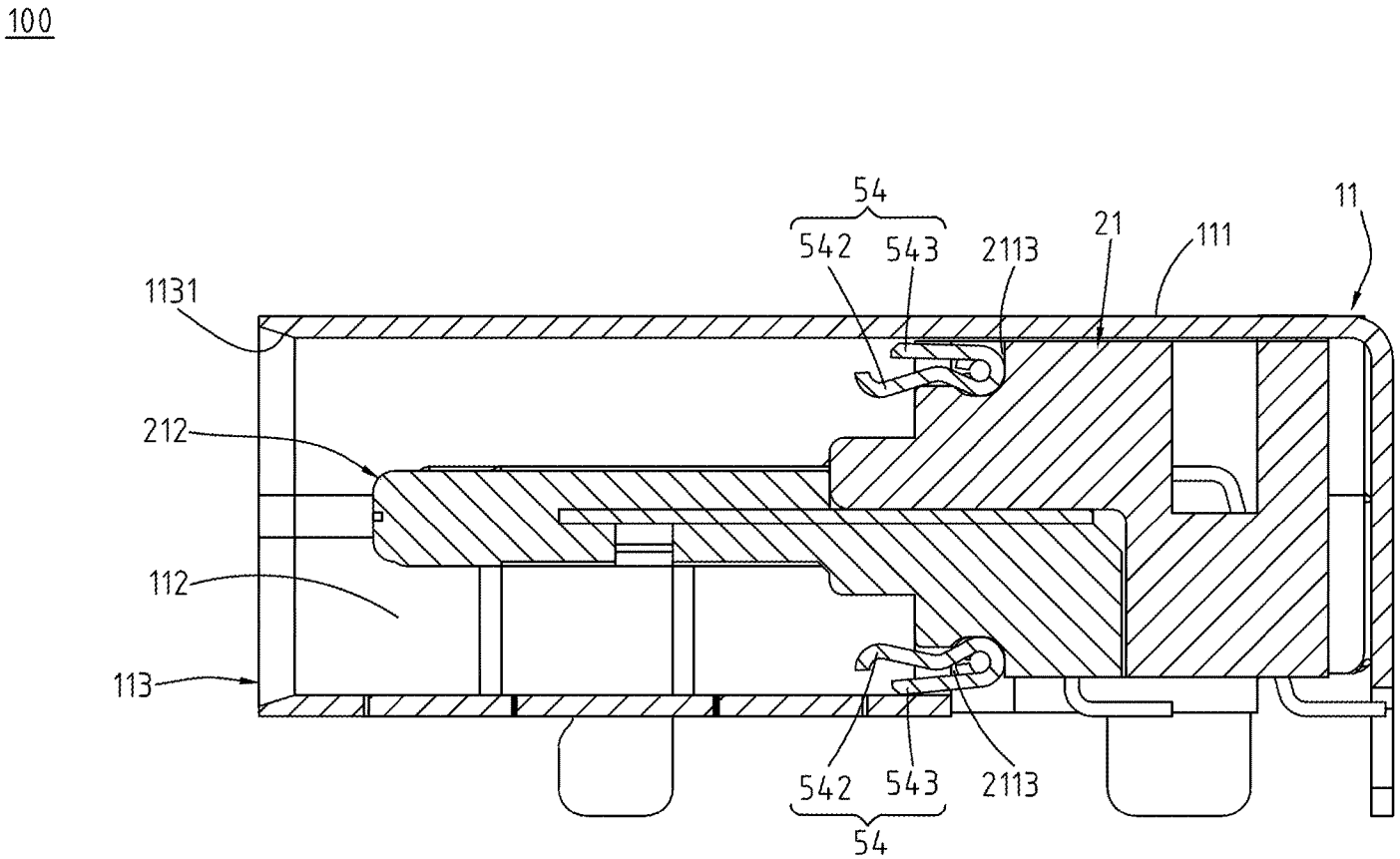
FIG. 17A illustrates a cross-sectional exploded view of the electrical receptacle connector according to the instant disclosure.
Figure 17B:
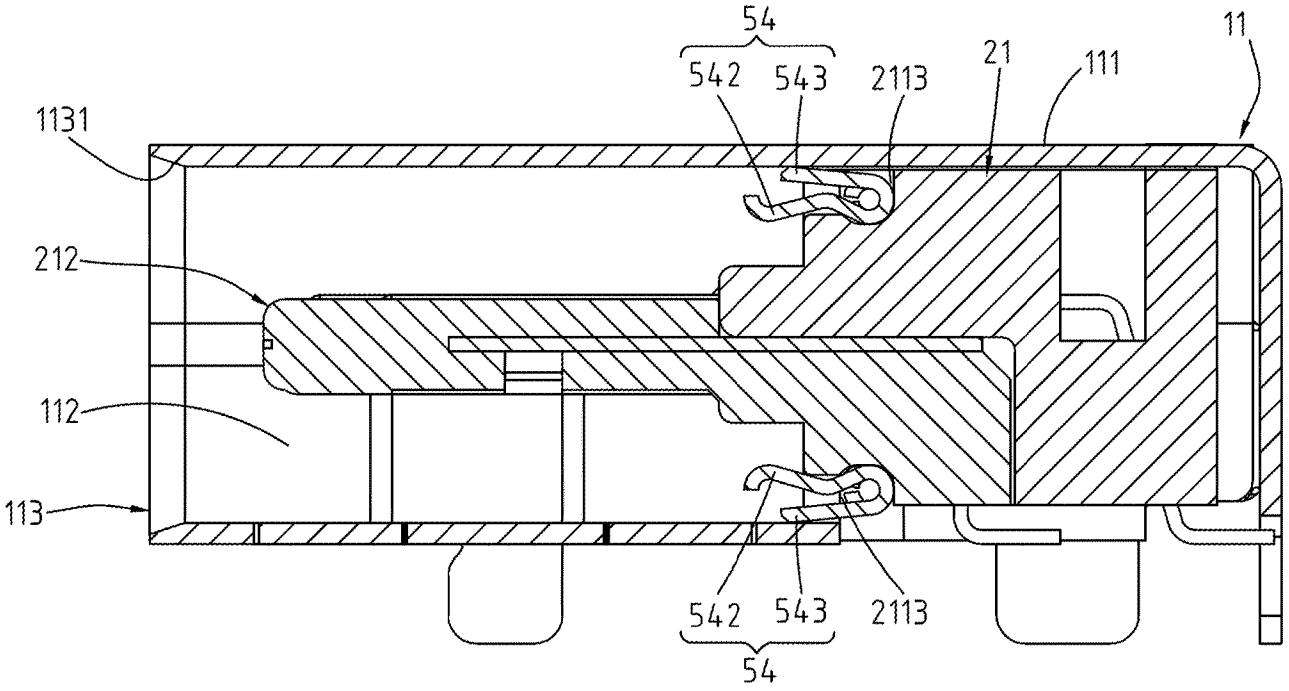
FIG. 17B illustrates a cross-sectional exploded view of the electrical receptacle connector according to the instant disclosure.

Please refer to FIGS. 17, 17A and 17B. In some embodiments, the electrical receptacle connector 100 is further provided with a plurality of conductive plates 54. Each of the conductive plates 54 is a V-profiled, clamping piece. The conductive plates 54 are respectively on the top portion and the bottom portion of the base portion 211. Here, the base portion 211 is provided with a plurality of recessed portions 2113 on the top surface 2111 and the bottom surface 2112 of the base portion 211, and the conductive plates 54 are accommodated in the recessed portions 2113, so that the conductive plates 54 are in contact with the inner wall of the metal shell 11. Here, each of the conductive plates 54 comprises a shaft 541, a drive portion 542, and a driven portion 543. For each conductive plate 54, the shaft 541 is pivotally received in the corresponding recessed portion 2113, the drive portion 542 is extending slantingly toward the tongue portion 112 from one of two sides of the shaft 541, and the driven portion 543 is extending from the other side of the shaft 541 and movably in contact with the inner wall of the metal shell 11. Accordingly, as shown in 17B, when the electrical plug connector is plugged into the electrical receptacle connector 100, the front end of the metal shell of the electrical plug connector would be in contact with the drive portions 542, so that each of the drive portions 542 rotates about the axis of the corresponding shaft 541 to simultaneously drive the corresponding driven portion 543 be in contact with the inner wall of the metal shell 11 of the electrical receptacle connector 100. Based on this, the conductive plates 54 allow effective conduction between the metal shell of the electrical plug connector and the metal shell 11 of the electrical receptacle connector 100, and the EMI problem can be further reduced.

Figure 14:
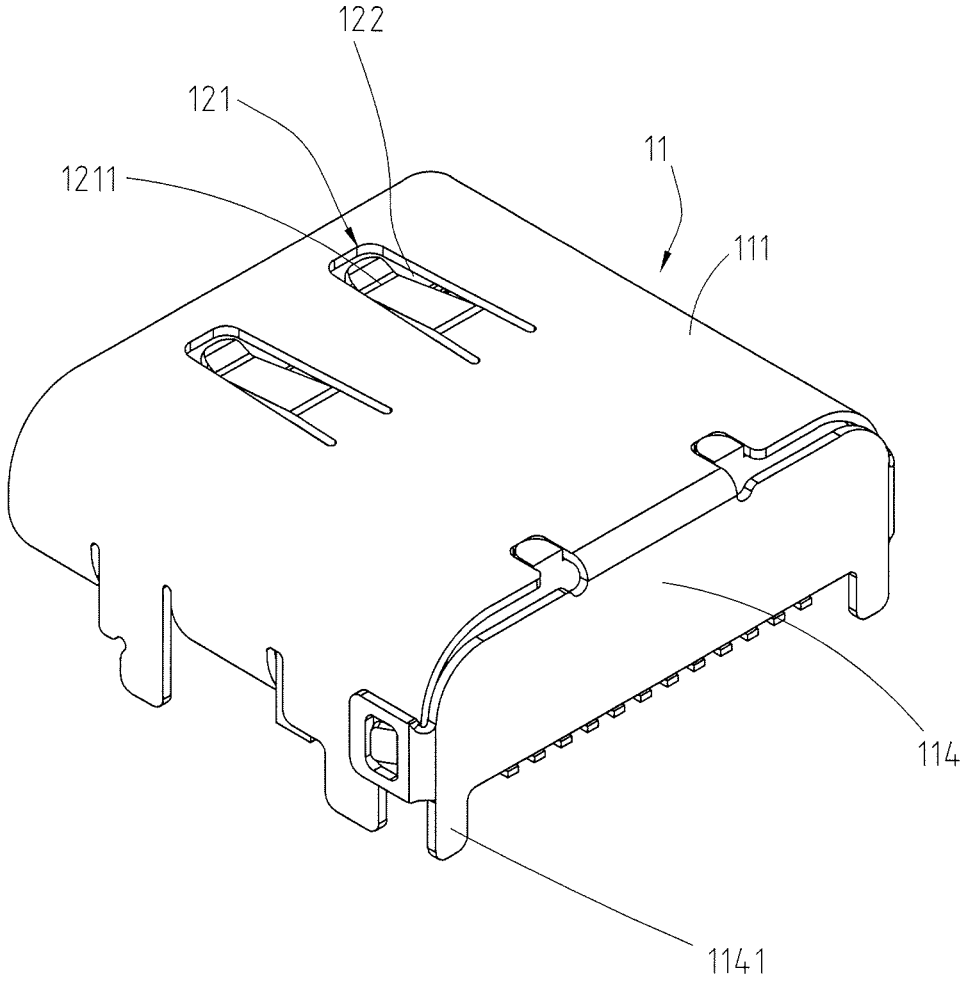
FIG. 14 illustrates another perspective view of the metal shell shown in FIG. 5.

Please refer to FIG. 1. In some embodiments, the metal shell 11 is further provided with an inclined guiding surface 1131 on the inner surface of the insertion opening 113. The inclined guiding surface 1131 facilitates the connection between the electrical plug connector and the electrical receptacle connector 100 when the electrical plug connector is to be inserted into the electrical receptacle connector 100. In addition, referring to FIG. 14, the metal shell 11 may be further provided with a rear cover portion 114 covering the rear part of the receptacle cavity 112. Accordingly, the exposed interior area of the metal shell 11 can be reduced with the rear cover portion 114. Moreover, the bottom of the rear cover portion 14 may be provided with a plurality of extension grounding sheets 1141 extending downward and vertically to be pins, i.e. vertical pins. The grounding of the electrical receptacle connector 100 can be further improved by the extension grounding sheet 1141.

Figure 18:
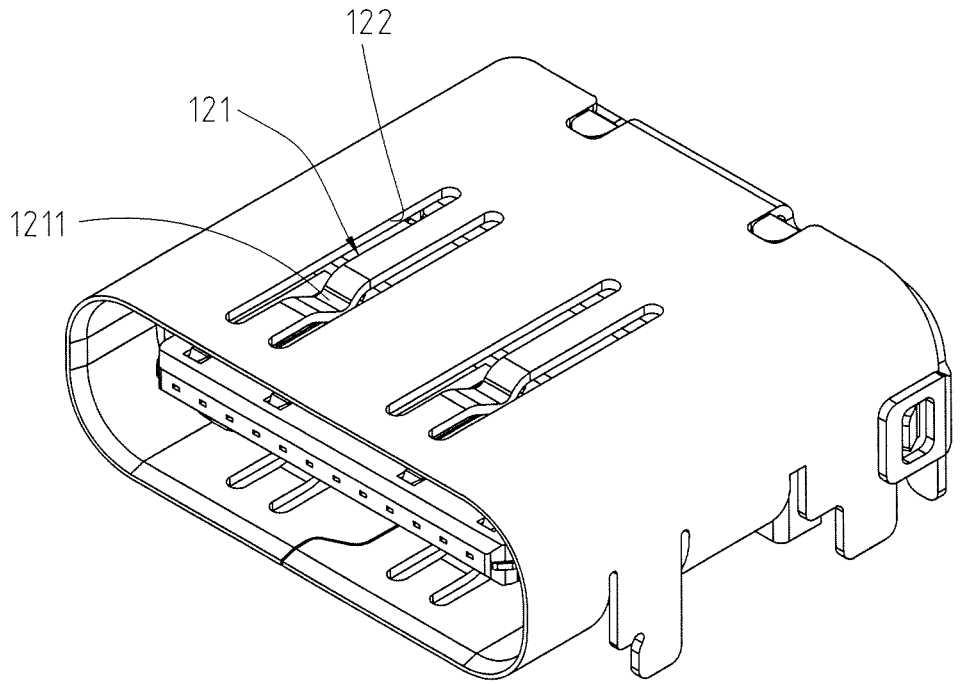
FIG. 18 is a perspective view illustrating the metal shell of the electrical receptacle connector according to the instant disclosure, where elastic sheets are assembled with the metal shell.

Please refer to FIG. 1. In some embodiments, the metal shell 11 is further provided with the elastic sheet 121 and the crack 122. The elastic sheet has a bent contact portion 1211 extending toward the receptacle cavity 112 for being in contact with the electrical plug connector. Besides, one of two ends of the elastic sheet 121 may be, but not limited to, in contact with the inner wall of the crack 122. Alternatively, in some embodiments, the two ends of the elastic sheet 121 may be respectively in contact with two opposite sides of the inner wall of the crack 122 (as shown in FIG. 18), and a bent contact portion 1211 is approximately configured on the middle portion of the elastic sheet 121. Accordingly, when the metal shell of the electrical plug connector is in contact with the bent contact portion 1211, because the two ends of the elastic sheet 121 are in contact with the inner wall of the crack 122, the motion of the bent contact portion 1211 is thus restricted and the bent contact portion 1211 does not protrude out of the metal shell 11.

Figure 19:
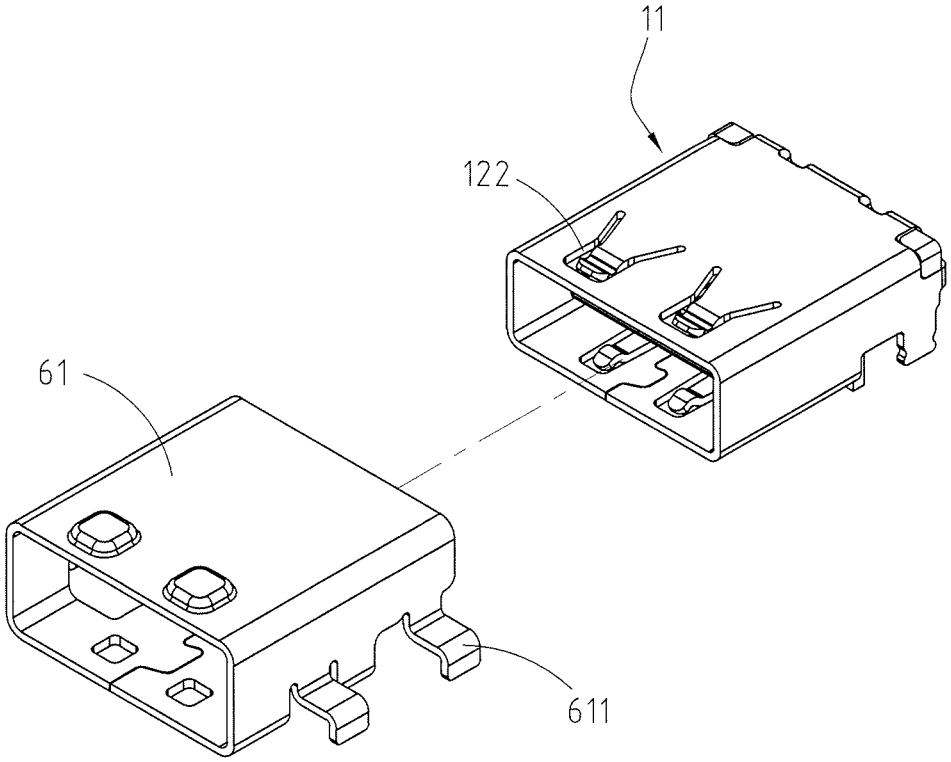
FIG. 19 is an exploded view illustrating a covering shell is combined with the electrical receptacle connector according to the instant disclosure.

Please refer to FIG. 19. In some embodiments, the electrical receptacle connector 100 may be further combined with a covering shell 61 covering the metal shell 11 so as to shield the crack 122 for improving waterproof. The covering shell 61 and the metal shell 11 may be combined with each other by buckling means or soldering means. Here, the covering shell 61 may be provided with a plurality of extending pins 611 extending downward and vertically. Accordingly, the electrical receptacle connector 100 can be installed to a sinking type circuit board.

Figure 21:
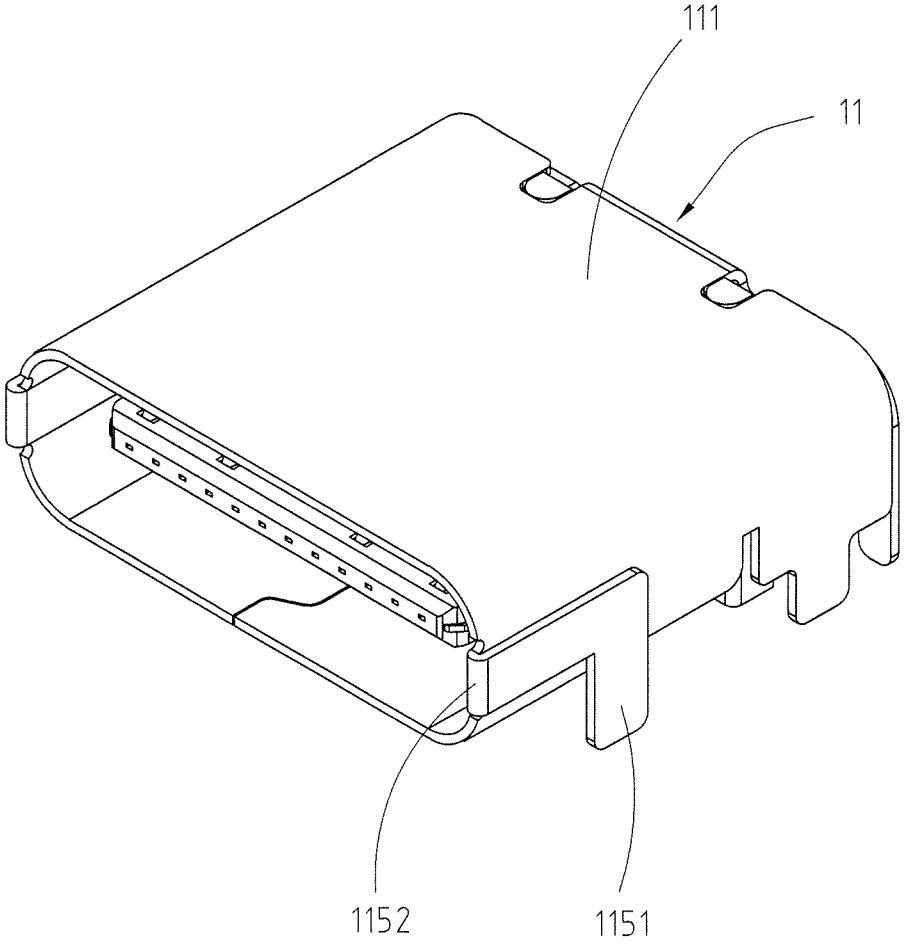
FIG. 21 illustrates a perspective view of the metal shell of the electrical receptacle connector according to the instant disclosure, where the metal shell is combined with a reversely-folded grounding piece, for one variation.

Please refer to FIG. 20. In some embodiments, the metal shell 11 further comprises a tubular portion 111, a reversely-folded grounding piece 1151, and a bent segment 1152. One of two ends of the bent segment 1152 is extending from the tubular portion 111 to be bent reversely, and the other end of the bent segment 1152 is extending toward the reversely-folded grounding piece 1151. Here, the bent segment 1152 may be, but not limited to, arranged at the rear part of the tubular portion 111. Alternatively, in some embodiments, the bent segment 1152 may be arranged at the front part of the tubular portion 111 (as shown in FIG. 21). Here, several reversely-folded grounding pieces 1151 are arranged on the two sides of the tubular portion 111 and extending downward and vertically. Accordingly, the electrical receptacle connector 100 can be installed on a sinking type circuit board.

Figure 26:
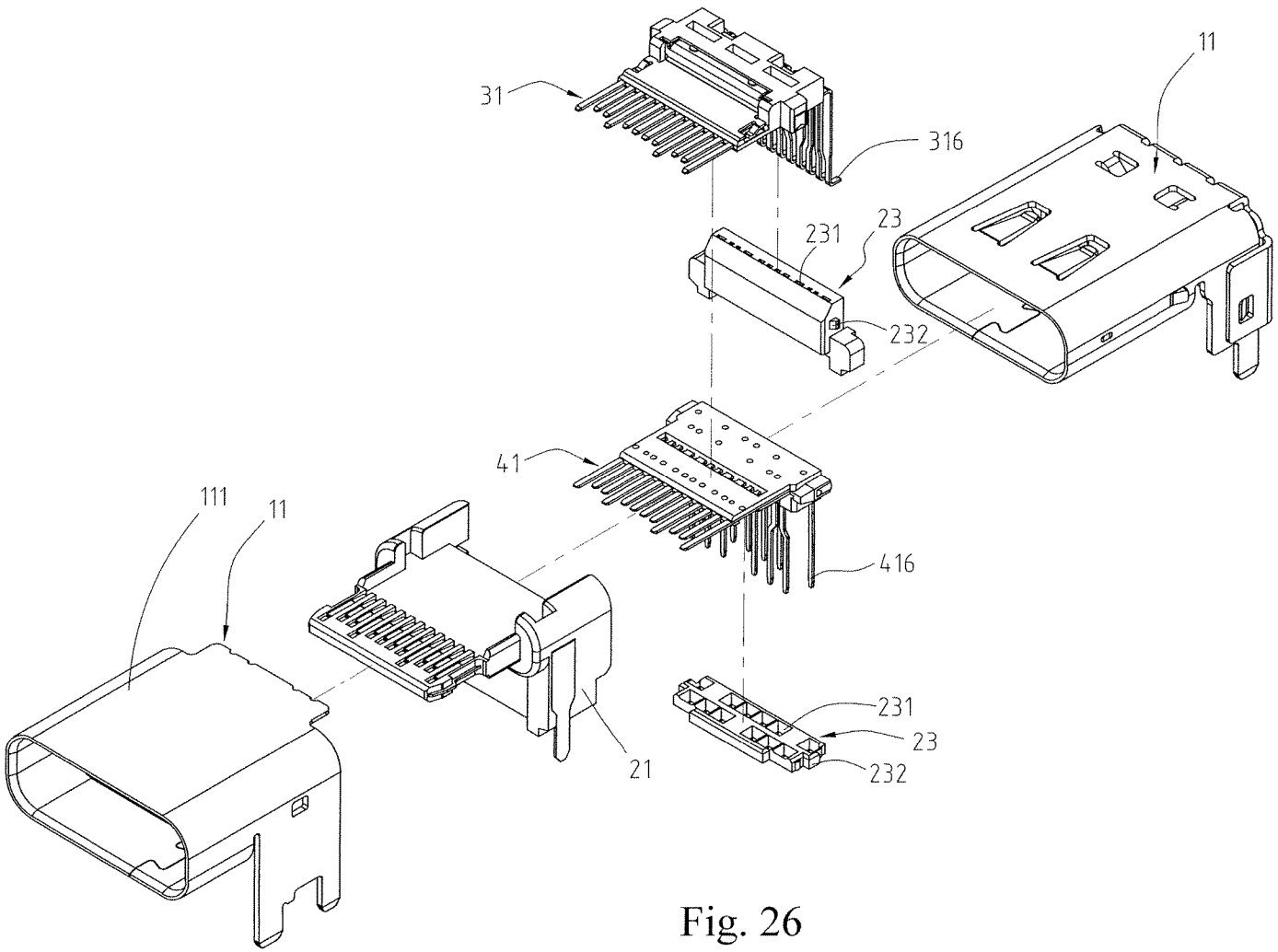
FIG. 26 illustrates an exploded view of the electrical receptacle connector provided with a rear terminal organizer, according to the instant disclosure.
Figure 27:
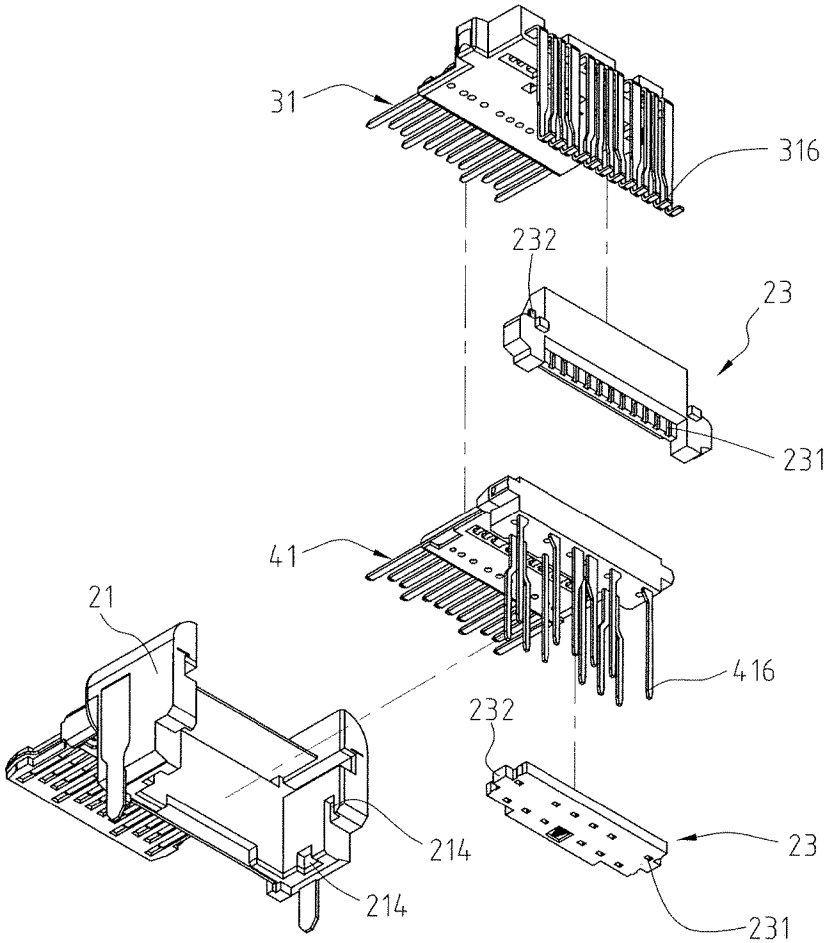
FIG. 27 illustrates a partial exploded view of the electrical receptacle connector provided with the rear terminal organizer, according to the instant disclosure.
Figure 28:
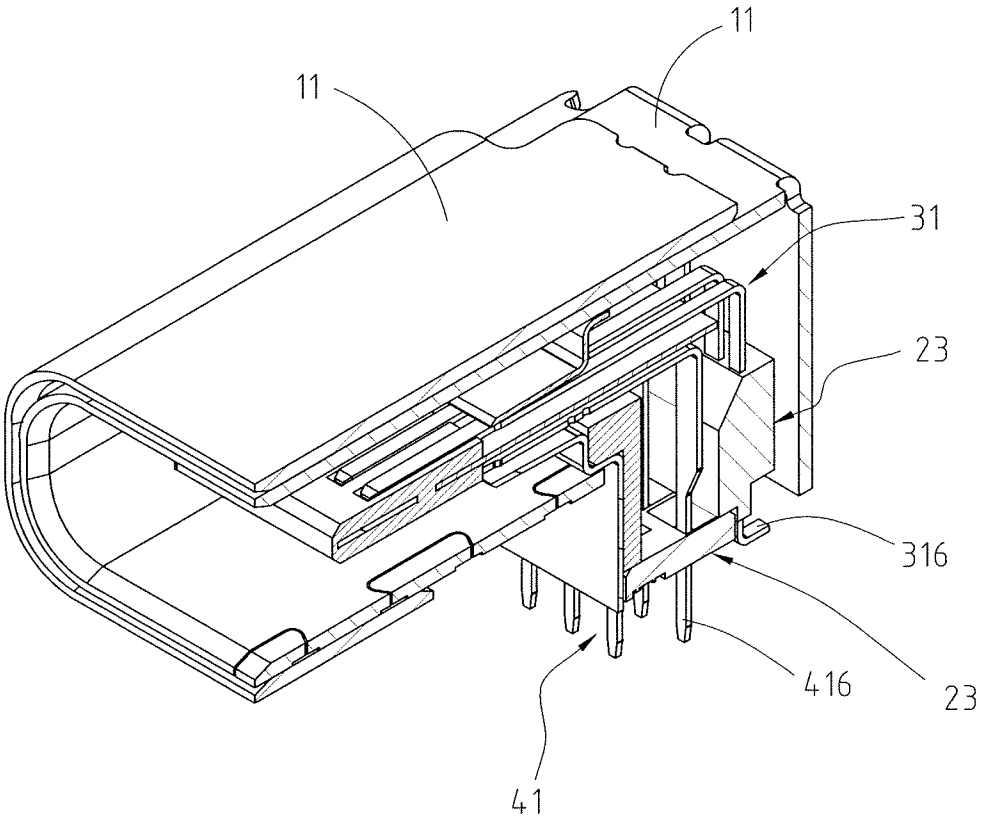
FIG. 28 illustrates a cross-sectional view of the electrical receptacle connector provided with the rear terminal organizer, according to the instant disclosure.

Please refer to FIG. 26 to FIG. 28. In some embodiments, the electrical receptacle connector 100 further comprises one or more rear terminal organizers 23. Here, several rear terminal organizers 23 are fixed at the rear part of the insulation housing 21. Each of the rear terminal organizers 23 are elongate shaped and comprises a main body, a plurality of through grooves 231 defined through the main body, and protruding blocks 232 protruded from the two sides of the main body. In addition, the upper-row soldering segments 316 and the lower-row soldering segments 416 are held in the through grooves 231, namely, the rear terminal organizers 23 are adapted to fit over the upper-row soldering segments 316 and the lower-row soldering segments 416. The rear terminal organizers 23 may be combined with the upper-row soldering segments 316 and the lower-row soldering segments 416 via insert-molding technique. When the rear terminal organizers 23 are to be assembled to the insulation housing 21, the protruded blocks 232 are engaged with engage cavities 214 defined at the rear part of the insulation housing 21. Accordingly, the upper-row soldering segments 316 and the lower-row soldering segments 416 are firmly positioned by the rear terminal organizers 23.

In conclusion, since the upper-row plate terminals and the lower-row plate terminals are arranged upside down, and the pin assignment of the upper-row plate signal terminals is left-right reversal with respect to that of the lower-row plate signal terminals. When an electrical plug connector is inserted into the electrical receptacle connector by a first orientation where the upper plane of electrical plug connector is facing up, upper-row elastic terminals of the electrical plug connector are in contact with the upper-row plate signal terminals. Conversely, when the electrical plug connector is inserted into the electrical receptacle connector by a second orientation where the lower plane of the electrical plug connector is facing up, the upper-row elastic terminals of the electrical plug connector are in contact with the lower-row plate signal terminals. Consequently, the inserting orientation of the electrical plug connector is not limited when inserting into the electrical receptacle connector. Moreover, a plurality of hook structures is protruded on the two sides of the tongue portion. Therefore, when an electrical plug connector is inserted into the electrical receptacle connector, the elastic pins on two sides of the electrical plug connector would not wear against the two sides of the tongue portion. In addition, a grounding sheet is configured to the insulation housing and between the upper-row contact segment and the lower-row contact segment, thus the crosstalk interference can be improved by the grounding sheet during signal transmission. Furthermore, the structural strength of the tongue portion can be further enhanced.

While the disclosure has been described by the way of example and in terms of the preferred embodiments, it is to be understood that the instant disclosure need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metal shell defining a receptacle cavity therein;

an insulation housing in the receptacle cavity, wherein the insulation housing comprises a base portion and a tongue portion extending from one side of the base portion, and the tongue portion comprises an upper surface and a lower surface;

a plurality of upper-row plate terminals held on the base portion and the tongue portion, wherein the upper-row terminals comprise a plurality of upper-row plate signal terminals, at least one upper-row plate power terminal, and at least one upper-row plate ground terminal, wherein the upper-row plate terminals are on the upper surface;

a plurality of lower-row plate terminals held on the base portion and the tongue portion, wherein the lower-row terminals comprise a plurality of lower-row plate signal terminals, at least one lower-row plate power terminal, and at least one lower-row plate ground terminal, wherein the lower-row plate terminals are on the lower surface; and a grounding sheet formed within the insulation housing, wherein the grounding sheet comprises a body portion, a plurality of pins, and a plurality of hook structures, wherein the body portion is located between upper-row contact segments of the upper-row plate terminals on the upper surface and lower contact segments of the lower-row plate terminals on the lower surface, and the two opposite sides of the body portion are exposed on the two opposite lateral sides of the tongue portion respectively, the pins are extending from a rear part of the grounding sheet and exposed out of the base portion, and bent downwardly to contact with a circuit board, the hook structures are held in the insulation housing and each comprises a projecting engaging portion and a projecting abutting portion, the projecting engaging portions are extending from two sides of the front part of the body portion and protruded from two sides of the tongue portion, the projecting abutting portions are extending from two sides of the rear part of the body portion and protruded from two sides of the base portion, the projecting abutting portions are in contact with the metal shell, and bent downward to contact with the circuit board;

wherein the upper-row plate terminals are on the upper surface for transmitting first signals, the lower-row plate terminals are on the lower surface for transmitting second signals, the specification for transmitting the first signals is conformed to the specification for transmitting the second signals, the upper-row plate terminals and the lower-row plate terminals are point-symmetrical with a central point of the receptacle cavity as the symmetrical center.

2. The electrical receptacle connector according to claim 1, wherein the distance between the at least one upper-row plate power terminal and a front lateral surface of the tongue portion is less than or equal to the distance between each of the upper-row plate signal terminals and the front lateral surface of the tongue portion.

3. The electrical receptacle connector according to claim 1, wherein the distance between the at least one upper-row plate ground terminal and the front lateral surface of the tongue portion is less than or equal to the distance between each of the upper-row plate signal terminals and the front lateral surface of the tongue portion.

4. The electrical receptacle connector according to claim 1, wherein the width of the at least one upper-row plate power terminal is greater than or equal to the width of each of the upper-row plate signal terminals.

5. The electrical receptacle connector according to claim 1, wherein the upper-row plate terminals comprise a plurality of upper-row soldering segments, the lower-row plate terminals comprise a plurality of lower-row soldering segments, and the upper-row soldering segments and the lower-row soldering segments are protruded out of the base portion to be arranged separately.

6. The electrical receptacle connector according to claim 5, wherein the upper-row soldering segments are horizontal pins, and wherein the lower-row soldering segments are the horizontal pins or vertical pins.

7. The electrical receptacle connector according to claim 5, further comprising a rear terminal organizer fixed at the rear part of the insulation housing, wherein the rear terminal organizer r comprises a plurality of through grooves, and the upper-row soldering segments and the lower-row soldering segments are held in the through grooves.

8. The electrical receptacle connector according to claim 1, wherein the distance between the at least one lower-row plate power terminal and a front lateral surface of the tongue portion is less than or equal to the distance between each of the lower-row plate signal terminals and the front lateral surface of the tongue portion.

9. The electrical receptacle connector according to claim 1, wherein the distance between the at least one lower-row plate ground terminal and the front lateral surface of the tongue portion is less than or equal to the distance between each of the lower-row plate signal terminals and the front lateral surface of the tongue portion.

10. The electrical receptacle connector according to claim 1, wherein the width of the at least one lower-row plate power terminal is greater than or equal to the width of each of the lower-row plate signal terminals.

11. The electrical receptacle connector according to claim 1, wherein the insulation housing comprises a first mount, wherein the upper-row plate terminals are combined with the first mount, the first mount is combined with the base portion.

12. The electrical receptacle connector according to claim 1, wherein the insulation housing comprises a second mount and a third mount, wherein the upper-row plate terminals are combined with the second mount, the second mount is combined to a top surface of the base portion, the lower-row plate terminals are combined with the third mount, the third mount is combined to a bottom surface of the base portion.

13. The electrical receptacle connector according to claim 1, wherein the metal shell defines an insertion opening therein, wherein the insertion opening is in the shape of oblong or rectangular.

14. The electrical receptacle connector according to claim 13, wherein the insertion opening comprises an inclined guiding surface.

15. The electrical receptacle connector according to claim 1, wherein the metal shell comprises a rear cover portion covering the rear part of the receptacle cavity.

16. The electrical receptacle connector according to claim 1, wherein the metal shell comprises an elastic sheet and a crack, wherein the elastic sheet is extending from the inner wall of the crack, the elastic sheet comprises a bent contact portion extending toward the receptacle cavity.

17. The electrical receptacle connector according to claim 1, further comprising a covering shell covering the metal shell.

18. The electrical receptacle connector according to claim 1, wherein the metal shell comprises a tubular portion, a reversely-folded grounding piece, and a bent segment, the reversely-folded grounding piece is arranged on the side portion of the tubular portion, one of two ends of the bent segment is extending from the tubular portion, and the other end of the bent segment is extending toward the reversely-folded grounding piece.

19. The electrical receptacle connector according to claim 1, further comprising an insulation casing for surrounding four sides of the metal shell.

20. The electrical receptacle connector according to claim 19, further comprising a waterproof gasket, wherein the insulation casing comprises a recessed portion and the waterproof gasket is fitted over the recessed portion.

21. The electrical receptacle connector according to claim 19, further comprising a waterproof cover at the rear part of the insulation casing to cover the rear part of the insulation casing.

22. The electrical receptacle connector according to claim 21, further comprising a sealing material at the rear part of the insulation casing to cover the rear part of the insulation casing.

23. The electrical receptacle connector according to claim 19, further comprising a sealing material at the rear part of the insulation casing to cover the rear part of the insulation casing.

24. The electrical receptacle connector according to claim 1, further comprising a waterproof gasket in the metal shell to abut against between the exterior of base portion and interior of the metal shell.

25. The electrical receptacle connector according to claim 1, wherein the electrical receptacle connector is devoid of the upper-row elastic terminals or the lower-row elastic terminals.

26. The electrical receptacle connector according to claim 1, wherein each of the upper-row plate terminals comprises an upper-row contact segment, an upper-row connecting segment, and an upper-row soldering segment, wherein the upper-row connecting segment is at the base portion and the tongue portion, the upper-row contact segment is extending from one of two ends of the upper-row connecting segment and on the upper surface, and the upper-row soldering segment is extending from the other end of the upper-row connecting segment and protruded out of the base portion.

27. The electrical receptacle connector according to claim 1, wherein each of the lower-row plate terminals comprises a lower-row contact segment, a lower-row connecting segment, and a lower-row soldering segment, wherein the lower-row connecting segment is on the base portion and the tongue portion, the lower-row contact segment is extending from one of two ends of the lower-row connecting segment and on the lower surface, and the lower-row soldering segment is extending from the other end of the lower-row connecting segment and protruded out of the base portion.

28. The electrical receptacle connector according to claim 1, wherein the position of the upper-row plate terminals corresponds to the position of the lower-row plate terminals.

29. The electrical receptacle connector according to claim 1, wherein the upper-row plate terminals are aligned parallel to the lower-row plate terminals, and the position of the upper-row plate terminals is offset with respect to the position of the lower-row plate terminals.

30. An electrical receptacle connector comprising:

a metal shell defining a receptacle cavity therein;

an insulation housing in the receptacle cavity, wherein the insulation housing comprises a base portion and a tongue portion extending from one side of the base portion, the tongue portion comprises an upper surface and a lower surface, and the base portion provided with a plurality of recessed portions on the top surface and the bottom surface;

a plurality of upper-row plate terminals held on the base portion and the tongue portion, wherein the upper-row terminals comprise a plurality of upper-row plate signal terminals, at least one upper-row plate power terminal, and at least one upper-row plate ground terminal, wherein the upper-row plate terminals are on the upper surface;

a plurality of lower-row plate terminals held on the base portion and the tongue portion, wherein the lower-row terminals comprise a plurality of lower-row plate signal terminals, at least one lower-row plate power terminal, and at least one lower-row plate ground terminal, wherein the lower-row plate terminals are on the lower surface;

a grounding sheet formed within the insulation housing and comprising a body portion located between upper-row contact segments of the upper-row plate terminals on the upper surface and lower contact segments of the lower-row plate terminals on the lower surface, wherein the two opposite sides of the body portion are exposed on the two opposite lateral sides of the tongue portion respectively;

a plurality of conductive plates respectively on the top portion and the bottom portion of the base portion to be in contact with the metal shell, wherein each of the conductive plates is a V-profiled comprises a shaft, a drive portion, and a driven portion, the conductive plates are accommodated in the recessed portions, the shaft is pivotally received in the corresponding recessed portion, the drive portion is extending slantingly toward the tongue portion from one of two sides of the shaft, and the driven portion is extending from the other side of the shaft and movably in contact with the inner wall of the metal shell; and wherein the upper-row plate terminals are on the upper surface for transmitting first signals, the lower-row plate terminals are on the lower surface for transmitting second signals, the specification for transmitting the first signals is conformed to the specification for transmitting the second signals, the upper-row plate terminals and the lower-row plate terminals are point-symmetrical with a central point of the receptacle cavity as the symmetrical center.

31. An electrical receptacle connector, comprising:

a metal shell defining a receptacle cavity therein;

an insulation housing in the receptacle cavity, wherein the insulation housing comprises a base portion and a tongue portion extending from the base portion, and the tongue portion comprises an upper surface and a lower surface;

a plurality of upper-row plate terminals held on the base portion and the tongue portion, wherein the upper-row plate terminals are on the upper surface;

a plurality of lower-row plate terminals held on the base portion and the tongue portion, wherein the lower-row plate terminals are on the lower surface; and a grounding sheet formed within the insulation housing, wherein the grounding sheet comprises a body portion located between upper-row contact segments of the upper-row plate terminals on the upper surface and lower contact segments of the lower-row plate terminals on the lower surface, and the two opposite sides of the body portion are exposed on the two opposite lateral sides of the tongue portion respectively;

wherein the upper-row plate terminals are on the upper surface for transmitting first signals, the lower-row plate terminals are on the lower surface for transmitting second signals, the specification for transmitting the first signals is conformed to the specification for transmitting the second signals, the upper-row plate terminals and the lower-row plate terminals are point-symmetrical with a central point of the receptacle cavity as the symmetrical center, and the electrical receptacle connector is operatively coupled to a corresponding plug connector in either of two insertion orientations.

32. The electrical receptacle connector according to claim 31, wherein the electrical receptacle connector is shaped to have 180 degree symmetry for coupling the corresponding plug connector in either of two insertion orientations and pin assignments of the upper-row plate terminals and the lower-low plate terminals are point-symmetrical with a central point of the receptacle cavity as the symmetrical center.

* * * * *